US009181074B2

(12) United States Patent
Clüsserath et al.

(10) Patent No.: US 9,181,074 B2
(45) Date of Patent: Nov. 10, 2015

(54) CONTAINER FILLING PLANT FOR FILLING CONTAINERS, SUCH AS DEMIJOHNS AND KEGS, WHICH FILLING PLANT HAS FILLER ELEMENTS FOR FILLING OF LARGE VOLUME CONTAINERS WITH A LIQUID PRODUCT, AND METHOD THEREFOR

(75) Inventors: Ludwig Clüsserath, Bad Kreuznach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 1236 days.

(21) Appl. No.: 12/711,816

(22) Filed: Feb. 24, 2010

(65) Prior Publication Data

US 2011/0048577 A1 Mar. 3, 2011

Related U.S. Application Data

(63) Continuation-in-part of application No. PCT/EP2008/005826, filed on Jul. 17, 2008.

(30) Foreign Application Priority Data

Aug. 24, 2007 (DE) ..... 10 2007 040 262

(51) Int. Cl.
*B67C 3/10* (2006.01)
*B67C 3/26* (2006.01)

(52) U.S. Cl.
CPC ..... *B67C 3/10* (2013.01); *B67C 2003/2668* (2013.01)

(58) Field of Classification Search
CPC ..... B67C 2003/2668; B67C 3/10
USPC ..... 141/8, 57, 61, 285, 7, 11, 48, 59, 63, 141/64, 66, 92; 222/148–151; 134/22.12; 53/425, 426, 432
See application file for complete search history.

(56) References Cited

U.S. PATENT DOCUMENTS

| | | | | | |
|---|---|---|---|---|---|
| 2,413,626 | A | * | 12/1946 | Hedges | 137/239 |
| 3,044,483 | A | * | 7/1962 | Wilburn | 137/239 |
| 3,336,720 | A | * | 8/1967 | Honisch | 53/470 |
| 3,765,142 | A | * | 10/1973 | Lindquist et al. | 53/407 |
| 4,386,637 | A | * | 6/1983 | Buchanan et al. | 141/65 |
| 5,445,194 | A | | 8/1995 | Clusserath | |

(Continued)

FOREIGN PATENT DOCUMENTS

| | | |
|---|---|---|
| DE | 39 12 153 C1 | 8/1990 |
| EP | 0 614 850 A1 | 9/1994 |

(Continued)

OTHER PUBLICATIONS

International Search Report PCT/EP2008/005826 and English translation thereof.
German Search Report 10 2007 040 262.9-23.

*Primary Examiner* — Timothy L Maust
(74) *Attorney, Agent, or Firm* — Nils H. Ljungman & Associates

(57) ABSTRACT

A container filling arrangement having a liquid duct to dispense a stream of liquid into a container, as well as a flushing tube disposed outside of the liquid duct. The flushing tube can be extended into the container to deliver flushing gas to flush out gas present in the container, and can then be retracted prior to filling of the container.

17 Claims, 7 Drawing Sheets

(56) References Cited

U.S. PATENT DOCUMENTS

| | | | | |
|---|---|---|---|---|
| 5,501,253 | A * | 3/1996 | Weiss | 141/40 |
| 5,653,091 | A * | 8/1997 | Stark | 53/426 |
| 6,155,314 | A * | 12/2000 | Ding et al. | 141/285 |
| 6,305,441 | B1 * | 10/2001 | Till | 141/90 |
| 2005/0180900 | A1 | 8/2005 | Popplau | |
| 2006/0283518 | A1 | 12/2006 | Ricker et al. | |

FOREIGN PATENT DOCUMENTS

| | | | |
|---|---|---|---|
| EP | 1 216 952 | A | 6/2002 |
| WO | WO 03/095353 | A | 11/2003 |
| WO | WO 2005/019090 | A1 | 3/2005 |

* cited by examiner

CONTAINER FILLING PLANT FOR FILLING CONTAINERS, SUCH AS DEMIJOHNS AND KEGS, WHICH FILLING PLANT HAS FILLER ELEMENTS FOR FILLING OF LARGE VOLUME CONTAINERS WITH A LIQUID PRODUCT, AND METHOD THEREFOR

CONTINUING APPLICATION DATA

This application is a Continuation-In-Part application of International Patent Application No. PCT/EP2008/005826, filed on Jul. 17, 2008, which claims priority from Federal Republic of Germany Patent Application No. 10 2007 040 262.9, filed on Aug. 24, 2007. International Patent Application No. PCT/EP2008/005826 was pending as of the filing date of this application. The United States was an elected state in International Patent Application No. PCT/EP2008/005826.

BACKGROUND

1. Technical Field

The present application relates to a container filling plant for filling containers, such as demijohns and kegs, which filling plant has filler elements for filling of large volume containers with a liquid product, and method therefor.

2. Background Information

Background information is for informational purposes only and does not necessarily admit that subsequently mentioned information and publications are prior art.

In the beverage industry, but also in other branches of industry, very often liquids, for example beverages, on which oxygen, usually atmospheric oxygen, has a damaging effect, have to be filled.

Thus, if it is absorbed by the liquid, the oxygen contained in the ambient air can have a negative influence, for example, with regard to shelf life, color, applicability, digestibility and/or taste.

Purely to simplify the comprehensibility of the present application, but in no way limiting the scope of protection of the present application, beverages are referred to exclusively below, said beverages being representative of all or virtually all comparable liquids that are sensitive to oxygen.

On account of the sensitivity to oxygen of numerous beverages, great efforts are made to keep the oxygen contained in the ambient air as far as possible away from the beverage to be filled during the production process.

One of such measures, for example, is to rinse the interior space of the container to be filled before the actual filling procedure, for example several times with an oxygen-free or low-oxygen process gas in order to remove the ambient air that is present there, and consequently also the atmospheric oxygen contained in said air, out of the container.

Some methods involve rinsing or flushing the container interior itself. Thus, the container interior is impinged upon several times with negative pressure, and then is brought back once again by the supplying of an oxygen-free process gas, for example $CO_2$, to a higher pressure, thereby clearly reducing the oxygen content in the container interior.

In the case of another method, which is used usually with unstable containers, a so-called rinsing or flushing tube is first of all introduced into the container. An oxygen-free process gas, for example $CO_2$, is then introduced through said rinsing or flushing tube into the container, said process gas displacing out of the container the ambient air situated inside the container. In this case, the container can also be impinged upon with a slight negative pressure or overpressure, the corresponding pressures being matched to the low stability of the container.

At least one possible embodiment of the present application relates to a device that operates as follows: the rinsing or flushing tube, positioned centrally relative to the filler element axis, is moved into the upper region of the container and is impinged upon with oxygen-free process gas. The oxygen-free process gas flowing out of the rinsing or flushing tube, after leaving the rinsing or flushing tube, flows, for instance, in the direction of the container bottom and in doing so displaces the gas present in the container, for example ambient air, in the direction of the container mouth where it can escape out of the container through a gas path provided at that location.

Once the rinsing or flushing process has been completed, the rinsing or flushing tube is moved out of the container, whereupon the liquid valve is opened, leading directly to the liquid product flowing into the container.

In at least one possible embodiment of the present application, the liquid product is set in rotation by a swirling body that is positioned inside the liquid path, thereby creating centrifugal forces which move or guide the liquid product to the inside wall of the container, thereby forming a liquid film that abuts against the inside wall of the container and flows into the container. Once the desired fill level has been obtained, the liquid valve is closed.

A disadvantage of such a method, among other things, is the large surface that the liquid flowing off the inside wall of the container has, as any oxygen still possibly remaining inside the container could be absorbed by said large surface. The larger the free surface and the greater the exposure time, the greater the amount of the oxygen possibly absorbed by the liquid flowing in.

Likewise, the small depth of insertion of the rinsing or flushing tube is disadvantageous as the oxygen-free process gas flows into the oxygenated gas there quasi midstream, thereby not resulting in an optimum, loss-free gas exchange.

With regard to the residual oxygen content and the operating efficiency, some methods and devices are stretched to the limit when the containers to be processed or filled exceed a certain volume.

This is also usually because some devices do not allow for the rinsing or flushing tube to be inserted far enough into the container in order to drive the ambient air in a targeted manner from one end of the container, namely the container bottom, in the direction of the other end of the container, namely the container mouth.

Another reason is that some filler elements, provided with a rinsing or flushing tube, operate exclusively according to the method of diverting the liquid to the inside walls of the container, which implies that as the diameter of the container increases so does the surface of the liquid flowing in. In addition, the greater container height causes the liquid to be exposed for longer. Both factors promote increased oxygen absorption of the liquid.

OBJECT OR OBJECTS

An object of at least one possible embodiment of the present application is to avoid or substantially avoid the above-mentioned faults and disadvantages.

SUMMARY

To this end, at least one possible embodiment of the present application proposes a filler element, which, on the one hand, enables free jet or full flow filling, and on the other hand, enables an improved rinsing or flushing process even with unstable, in at least one possible embodiment very large-volume containers, such as, for example, KEGs that are produced from a plastics material.

Essential elements of a filler element according to at least one possible embodiment of the present application have an arrangement of a rinsing or flushing tube and liquid product flow being separated spatially from one another and in a displaceable rinsing or flushing tube that has a very large adjusting range.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

At least one possible embodiment of the present application is described below, in which, in detail.

DESCRIPTION OF EMBODIMENT OR EMBODIMENTS

Figure 1:
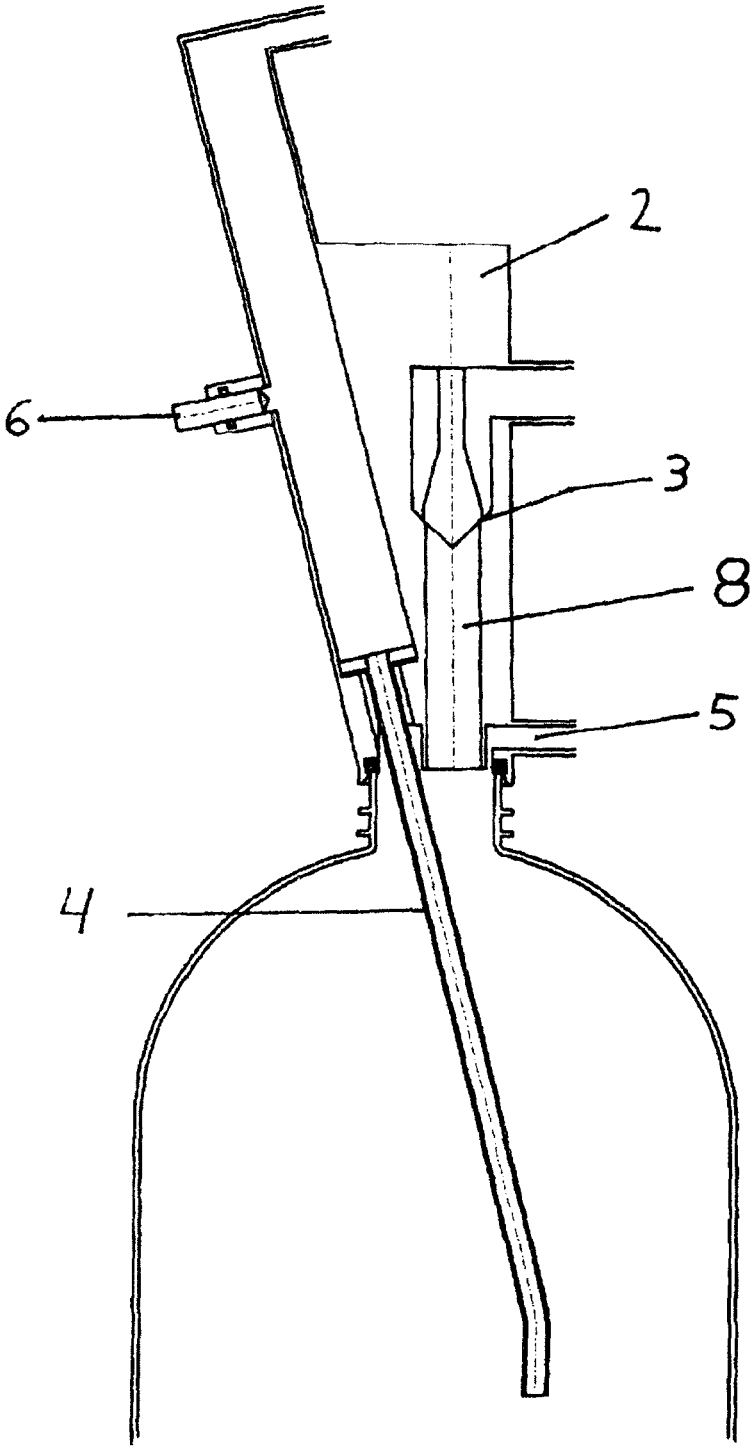
FIG. 1 shows a simplified sectional representation of a filler element according to at least one possible embodiment where the rinsing or flushing tube is situated in an operating position.

The following terminology is used within the framework of at least one possible embodiment of the present application:

Full Flow:

This term refers to a liquid flow, where the entire cross-sectional area at any time comprises just liquid, and which flows into the container 1 free or substantially free of external disturbances. In others words, full flow may refer to flow of liquid that is free or substantially free from disturbances. Full flow may also be called maximum flow. A maximum flow or full flow of liquid product may be contrasted with a filling process in which the liquid product is spun, swirled, or guided toward the walls of a container. A full flow or maximum flow may refer to a flow of liquid that is as uniform and laminar as possible.

Rinsing:

This term refers to the exchanging of the gas situated in the interior of the container, possibly containing a harmful amount of oxygen, with an oxygen-free process gas, it being possible to impinge upon the container to be rinsed or flushed at least intermittently with negative pressure or over pressure. Rinsing may also be called flushing or purging. This rinsing or flushing may entail the introduction of an oxygen-free gas or a substantially oxygen-free gas, for example, carbon dioxide or nitrogen, into the container 1. By flushing the container with the oxygen-free gas, substantially any amount of oxygen or oxygen-containing gas in the container 1 may be displaced out of the container 1.

Rinsing Tube:

This term refers to a displaceable element which holds or forms a controlled or non-controlled gas path, via which a gaseous medium is introducible into the interior of the container 1. The rinsing tube may also be called a flushing tube or purging tube. The rinsing or flushing or purging tube 4 may be displaceable in that the flushing tube 4 is able to be moved in and out of the container 1 by one or more various means. The flushing tube 4 may be inserted into the container 1 to thereby introduce an oxygen-free gas, such as, for example, carbon dioxide or nitrogen, into the container to flush oxygen or oxygen-containing gas, such as air, out of the container 1. In at least one possible embodiment of the present application, the flushing tube 4 may be configured to introduce a substantially uninterrupted flow of oxygen-free gas into the container 1 for a predetermined amount of time. In at least one possible embodiment, flushing tube 4 may be configured to introduce a flow of oxygen-free gas into the container 1 at intermittent intervals. When the flushing tube 4 is in a parked or retracted position, the flushing tube 4 may be located totally or virtually totally outside of the container 1. The flushing tube 4 may be held in the parked position by a holding or retaining device, such as, for example, a locking bolt 6. In at least one other possible embodiment of the present application, the holding or retaining device may be a magnetic or electromagnetic holding or retaining device. When the flushing tube 4 is in an operating or extended position, the flushing tube 4 may be located at least partially inside the container 1. When in the operating position, the flushing tube 4 may be used to introduce an oxygen-free or substantially oxygen-free gas into the container 1 as part of the flushing process.

Oxygen-Free Process Gas:

This term refers to a gas which contains no oxygen or only or virtually only such small quantities of oxygen or combinable oxygen that do not cause damage to the product to be filled over and above an admissible amount. Oxygen-free process gas may also be called oxygen-free gas. Some examples of oxygen-free gas may possibly be, for example, carbon dioxide or nitrogen.

FIG. 1 shows a filler element 2 according to at least one possible embodiment of the present application, with container 1 in a sealing position relative to the said filler element at the point of rinsing or flushing.

The container 1, to be rinsed or flushed and then to be filled, is situated in a sealing position with the filler element 2, the container 1 in at least one possible embodiment but not imperatively being retained at a neck ring.

In at least one possible embodiment of the present application, the container 1 may be in a sealed position in that container 1 and filling element 2 are completely or virtually completely enclosed from the outside atmosphere. Thus, when container 1 is in the sealed position to be filled at filling element 2, the flushing tube 4, the liquid duct 8, the liquid valve 3, and the gas path 5 may be completely or virtually completely enclosed by the structure of filling element 2 and by the structure of container 1.

The liquid valve 3 is closed. The rinsing or flushing tube 4 has been inserted into the container 1, and is situated in the operating position. The gas path 5 provided inside the filler element 2 is open and is connected, for example, to an outlet or a gas sink.

Oxygen-free process gas, for example $CO_2$ or nitrogen, passes through the rinsing or flushing tube 4 into the container 1. The rinsing or flushing tube 4 in at least one possible embodiment ends directly above the container bottom so that the oxygen-free process gas contacts the container bottom directly, and consequently, a gas flow or rinsing or flushing movement, proceeding from the container bottom, is generated in the direction of the gas path 5, said gas flow or rinsing or flushing movement displacing the oxygenated gas situated in the container 1, where possible in its entirety, in a swirl-free manner out of the container.

The rinsing or flushing tube 4 is in at least one possible embodiment designed in such a manner that the rinsing or flushing tube 4 is moved in and out purely by the pressure or the flow forces of the media flowing in or out of the container 1.

For example, in at least one possible embodiment of the present application, the flushing tube 4 may possibly be moved into the tube housing 9 by means of negative pressure. The flushing tube 4 may be configured so that negative pressure may be produced behind the rinsing tube 4 inside the tube housing 9. The negative pressure may be produced behind the flushing tube 4 by means of air being removed from inside the tube housing 9 at an increased rate relative to the rate of the movement of oxygen-free gas into container 1 via the flushing tube 4. The negative pressure produced inside the tube housing 9 behind the flushing tube 4 may move the flushing tube 4 into a parked position inside the tube housing 9.

The spatially separate arrangement, according to at least one possible embodiment of the present application, of rinsing or flushing tube 4 and liquid product flow, or of the liquid duct 8 conducting said liquid product flow and the additional measures made possible by said arrangement, make possible an extremely advantageous rinsing or flushing process with a likewise possible full flow filling.

In at least one possible embodiment of the present application, the flushing tube 4, when in the parked position, may be at a distance from the liquid duct 8 and out of the way of the liquid product flow. The flushing tube 4 therefore may be positioned in the parked position in such a way that the flushing tube 4 does not physically interrupt, disturb, influence, and/or reroute the movement of the full flow of liquid product, or the movement of the liquid product through the liquid duct 8.

In at least one possible embodiment, the flushing tube 4, the liquid duct 8, the liquid valve 3, and the gas path 5 may be housed within the singular body of filling element 2. The flushing tube 4 and the liquid duct 8 may be separate structures which may be disposed at a distance from one another within the singular body or structure of the filling element 2. When the container 1 is in the sealed position to be filled at filling element 2, the flushing tube 4, the liquid duct 8, the liquid valve 3, and the gas path 5 may be completely or virtually completely enclosed by a metallic structure of filling element 2 and by the structure of container 1. The metallic structure may house the flushing tube 4, the liquid duct 8, the liquid valve 3, and the gas path 5. In at least one possible embodiment, the structure of filling element 2 may possibly comprise metal. In at least one other possible embodiment, the structure of the filling element 2 may possibly comprise ceramic. In at least one other possible embodiment, the structure of the filling element 2 may possibly comprise plastic. In at least one other possible embodiment, the filling element 2 may possibly comprise one or more various other solid materials.

Figure 1A:
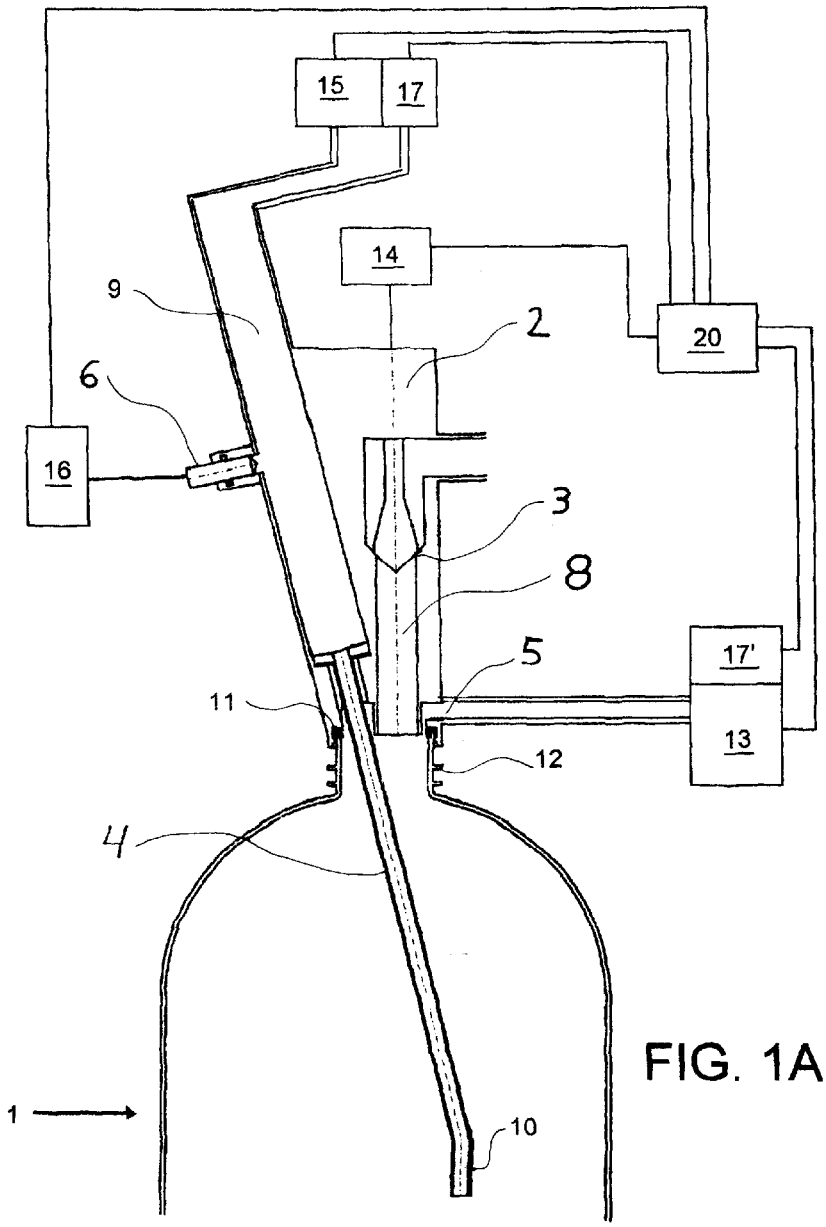
FIG. 1A shows a simplified sectional representation of a filler or filling element according to at least one possible embodiment where the rinsing or flushing tube is situated in an operating position.

FIG. 1A shows a simplified sectional representation of a filling element 2 according to at least one possible embodiment of the present application. FIG. 1A may show the container 1 in a position to be flushed of oxygenated gas and filled with liquid product at the filling element 2. The container 1 may be in a sealed position with the mouth of the container 1 pressed against the seal 11 inside the filling element 2. In the sealed position, the inside of the container 1 and the inside of the filling element 2 may be completely enclosed or virtually completely enclosed from the outside atmosphere. The container 1 may comprise threads 12 near the mouth of the container 1 utilized for later capping or sealing of the container 1.

The flushing tube 4 may be located inside the container 1 in an operating position. The main axis of the flushing tube 4 may be inclined relative to the longitudinal axis of the liquid duct 8. The flushing tube 4 may comprise a portion or tube end 10. The tube end 10 may be aligned vertically or substantially vertically relative to the inclined axis of the flushing tube 4. The tube end 10 may be disposed perpendicular, substantially perpendicular, or substantially transverse in relation to the bottom of the container 1. The flushing tube 4 may be configured to introduce an oxygen-free gas, for example, carbon dioxide or nitrogen, into the container 1, and, thereby, the flushing tube 4 may be configured to flush substantially any amount of oxygen or oxygenated gas out of the container 1 in the direction of the gas path 5. The oxygenated gas may be displaced into the gas path 5. The gas path 5 may be connected to a gas sink 13, into which the oxygenated gas in the gas path 5 may be displaced.

In at least one other possible embodiment of the present application, the gas path 5 may be configured to introduce an oxygen-free gas, for example, carbon dioxide or nitrogen, into the container 1. The gas path 5 may be configured to introduce an oxygen-free gas into the container 1. In such an embodiment, the flushing tube 4 may displace the oxygenated gas out of the container 1, for example, by means of negative pressure. The oxygenated gas may be displaced out of the container 1 through the flushing tube 4 into a gas tank or a gas sink 13. The oxygen-free gas introduced into the container 1 by the gas path 5 may be displaced out of the container 1 through the flushing tube 4, for example, by means of negative pressure. The oxygen-free gas introduced to the container 1 by the gas path 5 may be displaced out of the container 1 through the flushing tube 4. The oxygen-free gas and oxygenated gas may be displaced out of the container 1 through the flushing tube 4 into a gas tank or gas sink 13.

The flushing tube 4 may be moved into a parked or resting position completely or virtually completely outside of the container 1. The flushing tube 4 may be moved into a parked or resting position completely or virtually completely inside the tube housing 9. The flushing tube 4 may be moved into the tube housing 9 by means of a piston actuator 15. The flushing tube 4 may also be moved into the container 1 by means of the piston actuator 15. In at least one other possible embodiment of the present application, the movement of the flushing tube 4 into the tube housing 9 may possibly be controlled, activated, and/or influenced by one or more various means, for example, movement threads or screw drives, path measuring systems, linear drive systems, hydraulic drive systems, pneumatic drive systems, and/or other comparable systems. In at least one other possible embodiment of the present application, the movement of the flushing tube 4 into the container 1 may possibly be controlled, activated, and/or influenced by one or more various means, for example, movement threads or screw drives, path measuring systems, linear drive systems, hydraulic drive systems, pneumatic drive systems, and/or other comparable systems.

FIG. 1A may also show a vacuum pump 17' connected to the gas path 5. In at least one possible embodiment of the present application, the vacuum pump 17' may be configured to create a negative pressure inside the container 1. The vacuum pump 17' may be configured to displace a substantial amount of air from inside the container 1. The vacuum pump 17' may be configured to displace a substantial amount of oxygenated gas and at least a portion of oxygen-free gas out of the container 1. The oxygenated gas and the oxygen-free gas may be displaced from the container 1 through the gas path 5. In at least one possible embodiment, the flushing tube may be configured to be moved into the container 1 by means of the negative pressure created by the vacuum pump 17' inside the container 1. The flushing tube 4 may be configured so that the pressure behind the flushing tube 4 inside the tube housing 9 is greater than the negative pressure inside the container 1. The negative pressure inside the container 1 may move the flushing tube into the container 1.

FIG. 1A may also show the filling element 2 connected to a vacuum pump 17 inside the piston actuator 15. In at least one possible embodiment of the present application, the vacuum pump 17 may be configured to create a negative pressure behind the flushing tube 4 inside the tube housing 9. The vacuum pump 17 may be configured to displace a substantial amount of air from inside the tube housing 9. In at least one possible embodiment, the flushing tube 4 may be configured to be moved out of the container 1 by means of the negative pressure created by the vacuum pump 17. The flushing tube 4 may be configured so that the pressure inside the container 1 is greater than the negative pressure behind the flushing tube 4 inside the tube housing 9. The negative pressure inside the tube housing 9 may move the flushing tube 4 into the tube housing 9.

In at least one possible embodiment of the present application, the movement of the flushing tube 4 into the container 1 and out of the container 1 may be activated or influenced substantially by the pressure forces inside the container 1. For example, the vacuum pump 17' may be configured to create a negative pressure inside the container 1. The vacuum pump 17' may be configured to displace a substantial amount of air from inside the container 1. The flushing tube 4 may be configured so that the pressure behind the flushing tube 4 inside the tube housing 9 is greater than the negative pressure inside the container 1. The negative pressure inside the container 1 may move the flushing tube 4 into the container 1. The introduction of oxygen-free gas into the container 1 through the flushing tube 4 may create an overpressure inside the container 1. The vacuum pump 17 or a release valve (not shown) may be configured to release at least some of the pressure inside the tube housing 9. Thus, the relative overpressure inside the container 1 may move the flushing tube 4 out of the container 1 into the tube housing 9.

In at least one possible embodiment of the present application, the movement of the flushing tube 4 into the container 1 may be influenced or guided by a locking bolt 6. In at least one possible embodiment, the movement of flushing tube 4 into the tube housing 9 may be influenced or guided by a locking bolt 6. The locking bolt 6 may possibly be located adjacent to the tube housing 9. A locking mechanism 16 may move the locking bolt 6 into a locked position. When disposed in a locked position, at least a portion of the locking bolt 6 may be located inside the tube housing 9. When in the locked position, at least a portion of the locking bolt 6 may come in contact with the flushing tube 4 when the flushing tube 4 is disposed inside the tube housing 9. When in the locked position, the locking bolt 6 may influence or at least partially restrict or minimize the movement of the flushing tube 4 into the container 1. When in the locked position, the locking bolt 6 may restrict or minimize at least a portion of the flushing tube 4 from entering the container 1. In at least one other possible embodiment, the movement of the flushing tube 4 into the container 1 may possibly be restricted, minimized, influenced, guided, measured, and/or controlled by one or more of various means, for example, movement threads or screw drives, path measuring systems, linear drive systems, pneumatic drive systems, hydraulic drive systems, and/or other comparable systems.

FIG. 1A may also show a controller 20 which controller may be configured to control or activate the apparatuses of the filler element 2. The locking bolt 6, the piston actuator 15, the vacuum pump 17, the liquid valve actuator 14, the vacuum pump 17', and the gas sink 13 may be configured to be connected to the controller 20.

FIG. 1A may also show a liquid valve 3 and a liquid duct 8 disposed on a vertical or substantially vertical longitudinal axis. The liquid valve 3 may be configured to introduce a full flow or maximum flow of liquid product into the liquid duct 8. The liquid duct 8 may conduct or permit a full flow of liquid product into the container 1. The full flow of liquid product may be introduced from the liquid valve 3 into the liquid duct 8 when the liquid valve 3 is open. The opening and closing of the liquid valve 3 may be controlled or activated by a liquid valve motor 14.

In at least one possible embodiment of the present application, the liquid valve 3 may be in a closed position when the flushing tube is disposed in the operating position inside the container 1. The liquid valve 3 may be open when the flushing tube 4 is disposed completely or virtually completely inside the tube housing 9. The liquid valve 3 may be open when the flushing tube 4 is completely or virtually completely outside of the container 1. Therefore, the flushing tube 4 may be disposed inside the tube housing 9 in such a way that the flushing tube 4 does not physically or structurally interrupt, disturb, influence, and/or reroute the full flow of the liquid product from the liquid valve 3. The flushing tube 4 may be disposed inside the tube housing 9 in such a way that the flushing tube 4 does not physically or structurally interrupt, disturb, influence, and/or reroute the full flow or maximum flow of the liquid product through the liquid duct 8. The flushing tube 4 may be disposed inside the tube housing 9 in such a way that the flushing tube 4 does not physically or structurally interrupt, disturb, influence, and/or reroute the full flow of the liquid product into the container 1.

In at least one possible embodiment of the present application, the flushing tube 4, when in the parked or retracted position, may be disposed inside the tube housing 9 in such a way that the flushing tube 4 does not physically interrupt, influence, or interfere with the removal of the container 1 from the seal 11. In at least one possible embodiment, the flushing tube 4, the tube housing 9, the liquid valve 3, and the liquid duct 8 may be arranged inside the filling element 2 in such a way that the structures of the flushing tube 4, the tube housing 9, the liquid duct 8, and the liquid valve 3 do not interrupt, influence, or interfere with the removal of the container 1 from the seal 11.

In at least one other possible embodiment of the present application, the liquid valve 3 may be offset from the vertical or substantially vertical longitudinal axis of the liquid duct 8 and from the path of liquid product flow into the container 1. The offsetting of the liquid valve 3, or the positioning of the liquid valve 3, may possibly permit space for the tube housing 9 to be disposed parallel or substantially parallel to the longitudinal axis of the liquid duct 8 and to the path of the liquid product flow into the container 1. The offsetting of the liquid valve 3, or the positioning of the liquid valve 3, may possibly permit space for the flushing tube 4 to be disposed parallel or substantially parallel to the longitudinal axis of the liquid duct 8 and to the path of the liquid product flow into the container 1. Thus, the flushing tube 4 may be inserted into the container 1 along a longitudinal axis parallel or substantially parallel to the liquid duct 8 and to the liquid product flow into the container 1.

In at least one other possible embodiment, the tube housing 9 and the flushing tube 4 may comprise a vertical or substantially vertical longitudinal axis. The axis of the liquid duct 8 may be inclined relative to the vertical or substantially vertical longitudinal axis of the flushing tube 4 and the tube housing 9. Thus, the path of the full flow of liquid product into the container 1 may be inclined relative to the vertical or substantially vertical longitudinal axis of the flushing tube 4 and of the tube housing 9.

Figure 1B:
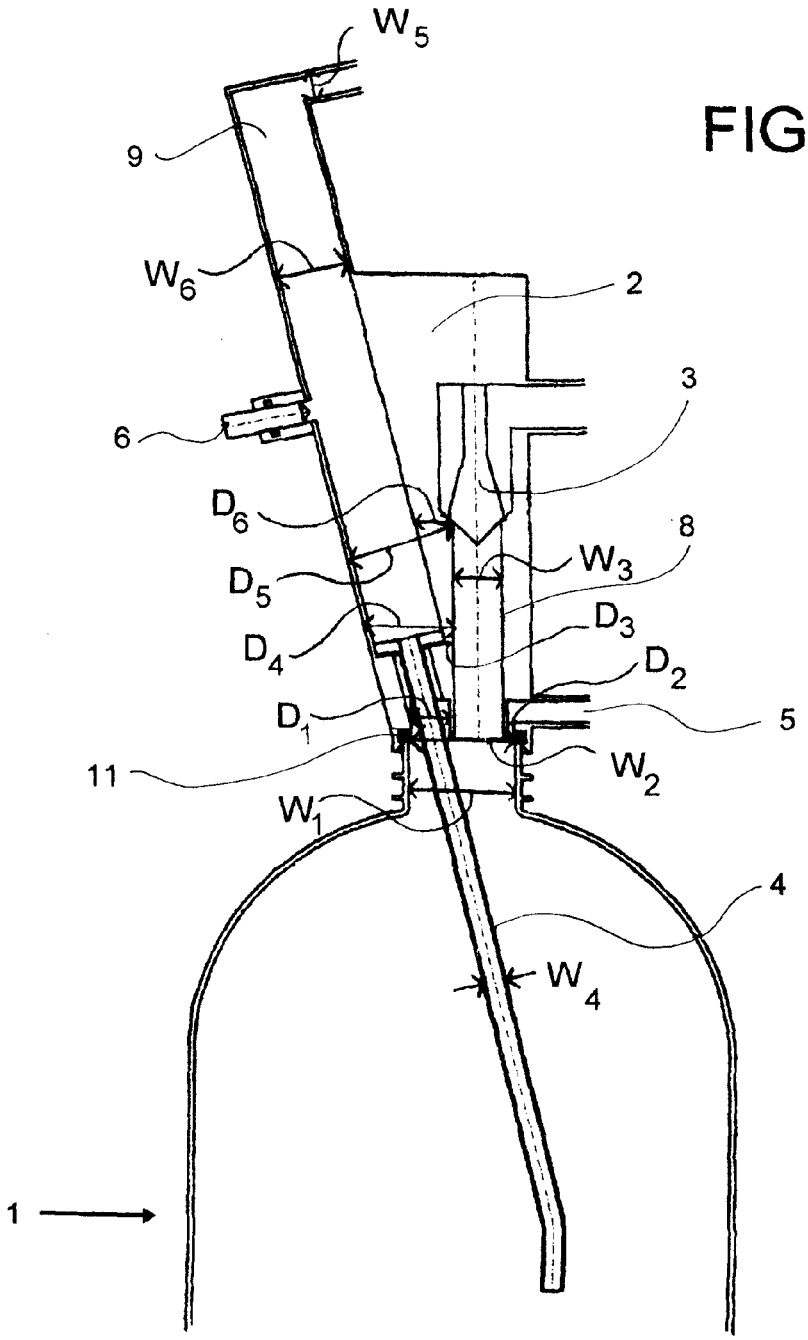
FIG. 1B shows a simplified sectional representation of a filling element according to at least one possible embodiment where the rinsing or flushing tube is situated in an operating position.

FIG. 1B shows a simplified sectional representation of a filling element 2 according to at least one possible embodiment of the present application. FIG. 1B may show the container 1 in a position to be flushed of oxygenated gas and filled with liquid product at the filling element 2. The container 1 may be in a sealed position with the mouth of the container 1 pressed against the seal 11 inside the filling element 2. The flushing tube 4 may be located inside the container 1 in an operating position. The main axis of the flushing tube 4 may be inclined relative to the vertical or substantially vertical longitudinal axis of the liquid duct 8.

In one possible embodiment of the present application, the diameter $W_1$ of the mouth of container 1 may be sixteen millimeters. The diameter $W_2$ of the seal 11 at the opening of the filling element 2 may be sixteen millimeters. The proportion of the mouth diameter $W_1$ to the seal diameter $W_2$ may be equal to one. The mouth diameter $W_1$ and the seal diameter $W_2$ may be equal or substantially equal.

The seal diameter $W_2$ at the opening of the filling element 2 may be sixteen millimeters. The circular area of the seal 11 at the opening of the filling element 2 may be 201.06 square millimeters. The diameter $W_3$ of the liquid duct 8 may be eight millimeters. The circular area of the opening of liquid duct 8 may be 50.26 square millimeters. The proportion of the liquid duct diameter $W_3$ to the seal diameter $W_2$ may be 0.50 or a one to two ratio. The proportion of the liquid duct 8 circular area to the seal 11 circular area may be 0.25 or a one to four ratio. The diameter $W_4$ of the flushing tube 4 may be four millimeters. The circular area at the opening of the flushing tube 4 may be 12.57 square millimeters. The proportion of the flushing tube diameter $W_4$ to the seal diameter $W_2$ may be 0.25 or a one to four ratio. The proportion of the flushing tube diameter $W_4$ to the liquid duct diameter $W_3$ may be 0.50 or a one to two ratio. The proportion of the flushing tube 4 circular area to the seal 11 circular area may be 0.0625, or a one to sixteen ratio. The proportion of the flushing tube 4 circular area to the liquid duct 8 circular area may be 0.25 or a one to four ratio.

The opening of the gas path 5 may have a width $D_2$ of one millimeter. The proportion of the gas path width $D_2$ to the seal diameter $W_2$ may be 0.0625 or a one to sixteen ratio. The proportion of the gas path width $D_2$ to the liquid duct diameter $W_3$ may be 0.125 or a one to eight ratio. The proportion of the gas path width $D_2$ to the flushing tube diameter $W_4$ may be 0.25 or a one to four ratio.

The distance $D_1$ at the seal 11 of the filling element 2 may be the distance not taken up by the gas path 5 and the liquid duct 8 at the opening of the filling element 2. The distance $D_1$ may be 7 millimeters. The proportion of the distance $D_1$ to the seal diameter $W_2$ may be 0.4375 or a seven to sixteen ratio. The distance $D_1$ may permit the flushing tube 4 to be inserted into the container 1. The diameter $W_4$ of the flushing tube 4 may be four millimeters. The proportion of the flushing tube diameter $W_4$ to the distance $D_1$ may be 0.57 or a four to seven ratio. The proportion of the flushing tube diameter $W_4$ to the gas path width $D_2$ may be four or a four to one ratio.

The diameter $W_6$ of the tube housing 9 may be twelve millimeters. The proportion of the tube housing width $W_6$ to the seal diameter $W_2$ may be 0.75 or a three to four ratio. The proportion of the flushing tube diameter $W_4$ to the tube housing width $W_6$ may be 0.333 or a one to three ratio. The proportion of the tube housing width $W_6$ to the liquid duct diameter $W_3$ may be 1.5 or a three to two ratio. The tube housing gap width $W_5$ may be four millimeters. The proportion of the tube housing gap width $W_5$ to the tube housing width $W_6$ may be 0.333 or a one to three ratio. The proportion of the tube housing gap width $W_5$ to the flushing tube diameter $W_4$ may be one or a one to one ratio. The tube housing gap width $W_5$ and the flushing tube diameter $W_4$ may be equal or substantially equal.

The distance $D_3$ between the liquid duct 8 and the tube housing 9 may be one millimeter. The proportion of the distance $D_3$ to the seal diameter $W_2$ may be 0.0625 or a one to sixteen ratio. The proportion of the distance $D_3$ to the tube housing width $W_6$ may be 0.0833 or a one to twelve ratio. The proportion of the distance $D_3$ to the liquid duct diameter $W_3$ may be 0.125 or a one to eight ratio.

The distance $D_4$ between the liquid duct 8 and the outside wall of the tube housing 9 may be nine millimeters. The proportion of the distance $D_4$ to the seal diameter $W_2$ may be 0.5625 or a nine to sixteen ratio. The proportion of the distance $D_4$ to the tube housing width $W_6$ may be 0.75 or a three to four ratio. The proportion of the distance $D_4$ to the liquid duct width $W_3$ may be 1.125 or a nine to eight ratio. The proportion of the distance $D_4$ to the flushing tube diameter $W_4$ may be 2.25 or a nine to four ratio.

The distance $D_5$ between the liquid duct 8 and the outside wall of the tube housing 9 may be seventeen millimeters. The proportion of the distance $D_5$ to the seal diameter $W_2$ may be 1.0625 or a seventeen to sixteen ratio. The proportion of the distance $D_5$ to the tube housing width $W_6$ may be 1.416 or a seventeen to twelve ratio. The proportion of the distance $D_5$ to the liquid duct diameter $W_3$ may be 2.125 or a seventeen to eight ratio. The proportion of the distance $D_5$ to the flushing tube diameter $W_4$ may be 4.25 or a seventeen to four ratio.

The distance $D_6$ between the liquid duct 8 and the interior wall of the tube housing 9 may be seven millimeters. The proportion of the distance $D_6$ to the seal diameter $W_2$ may be 0.4375 or a seven to sixteen ratio. The proportion of the distance $D_6$ to the tube housing width $W_6$ may be 0.583 or a seven to twelve ratio. The proportion of the distance $D_6$ to the liquid duct diameter $W_3$ may be 0.875 or a seven to eight ratio. The proportion of the distance $D_6$ to the flushing tube diameter $W_4$ may be 1.75 or a seven to four ratio.

The proportion of the distance $D_3$ to the distance $D_4$ may be 0.111 or a one to nine ratio. The proportion of the distance $D_4$ to the distance $D_5$ may be 0.529 or a nine to seventeen ratio. The proportion of the distance $D_5$ to the distance $D_6$ may be 2.428 or a seventeen to seven ratio.

Other possible embodiments may possibly utilize other ratios, proportions, and/or dimensions. For example, some embodiments may utilize greater ratios, proportions, and/or dimensions. Some embodiments may, for example, utilize smaller ratios, proportions, and/or dimensions.

Figure 1C:
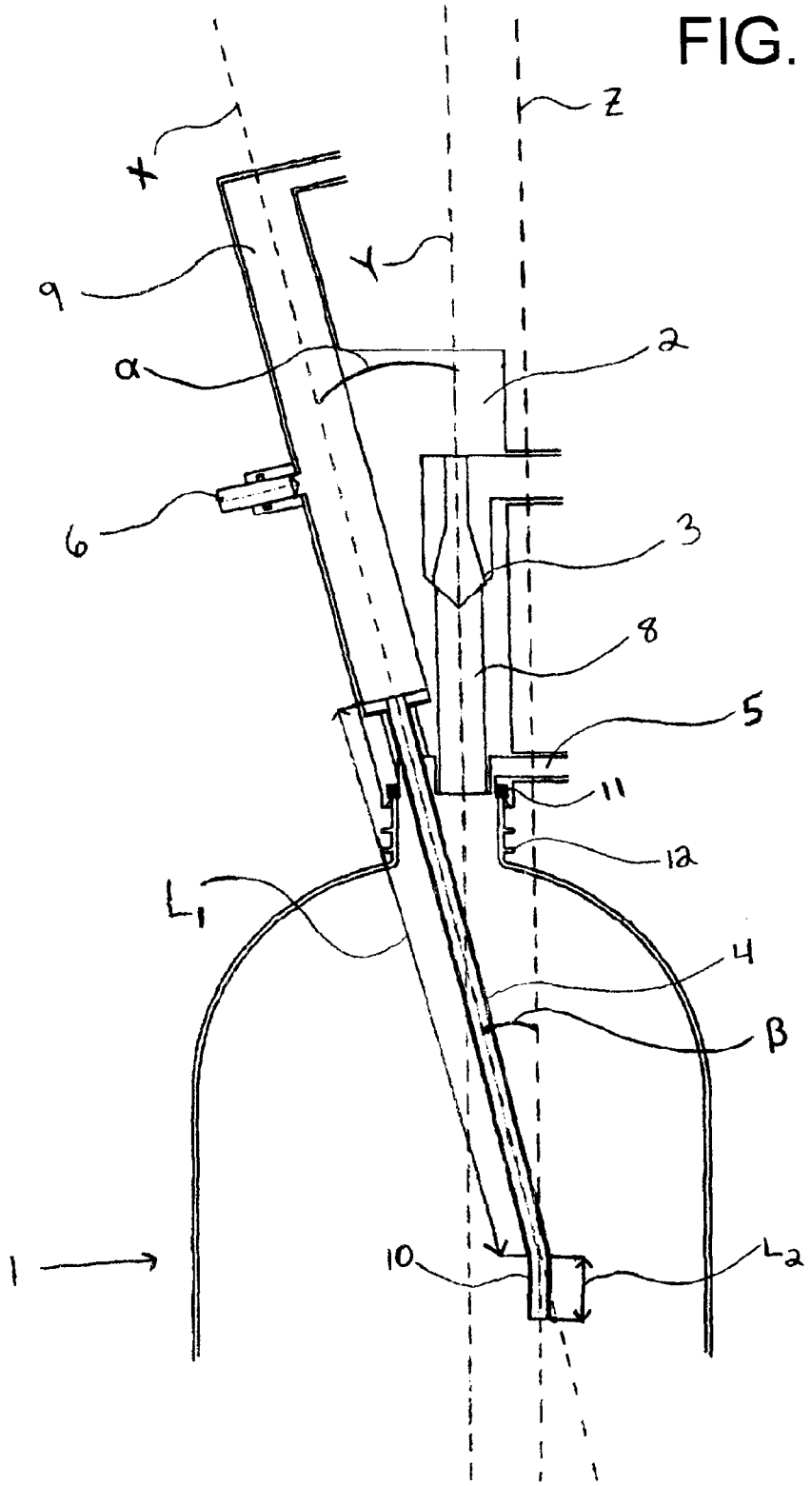
FIG. 1C shows a simplified sectional representation of a filling element 2 according to at least one possible embodiment where the rinsing or flushing tube is situated in an operating position.

FIG. 1C shows a simplified sectional representation of a filling element 2 according to at least one possible embodiment of the present application. FIG. 1C may show the container 1 in a position to be flushed of oxygenated gas and filled with liquid product at the filling element 2. The container 1 may be in a sealed position with the mouth of the container 1 pressed against the seal 11 inside the filling element 2. The flushing tube 4 may be located inside the container 1 in an operating position.

The liquid valve 3 and the liquid duct 8 may comprise a vertical or substantially vertical longitudinal axis Y. The flushing tube 4 and the tube housing 9 may comprise an inclined axis X that is inclined relative to the longitudinal axis Y. The inclined axis X and the longitudinal axis Y may intersect to create an angle $\alpha$. The angle $\alpha$ between the inclined axis X and the longitudinal axis Y may be thirteen degrees. In at least one other possible embodiment of the present application, the angle $\alpha$ between the longitudinal axis Y and the inclined axis X may be twenty-six degrees. In at least one other possible embodiment, the angle $\alpha$ between the longitudinal axis Y and the inclined axis X may be 6.5 degrees. In other possible embodiments of the present application, the angle $\alpha$ between the longitudinal axis Y and the inclined axis X may vary degrees or by any increments or fractions of degrees within the range of 6.5 degrees to twenty-six degrees. In at least one other possible embodiment of the present application, the angle $\alpha$ between the longitudinal axis Y and the inclined axis X may be less than 6.5 degrees. In at least one other possible embodiment, the angle $\alpha$ between the longitudinal axis Y and the inclined axis X may be greater than twenty-six degrees.

FIG. 1C may also show the tube end 10 comprising a vertical or substantially vertical longitudinal axis Z. The flushing tube 4 and the tube housing 9 may comprise an inclined axis X that is inclined relative to the longitudinal axis Z. The angle $\beta$ between the inclined axis X and the longitudinal axis Z may be thirteen degrees. In at least one other possible embodiment, the angle $\beta$ between the longitudinal axis Z and the inclined axis X may be 6.5 degrees. In at least one other possible embodiment of the present application, the angle $\beta$ between the longitudinal axis Z and the inclined axis X may be twenty-six degrees. In other possible embodiments of the present application, the angle $\beta$ between the longitudinal axis Z and the inclined axis X may vary degrees or by any increments or fractions of degrees within the range of 6.5 degrees and twenty-six degrees. In at least one other possible embodiment, the angle $\beta$ between the longitudinal axis Z and the inclined axis X may be less than 6.5 degrees. In at least one other possible embodiment of the present application, the angle $\beta$ between the longitudinal axis Z and the inclined axis X may be greater than twenty-six degrees.

In one possible embodiment of the present application, the length $L_1$ of the flushing tube 4 may be ninety-eight millimeters. The length $L_2$ of the tube end 10 may be ten millimeters. The proportion of the tube end length $L_2$ to the flushing tube length $L_1$ may be 0.102 or a five to forty-nine ratio. In at least one other possible embodiment, the flushing tube length $L_1$ may be less than ninety-eight millimeters. In at least one other possible embodiment of the present application, the flushing tube length $L_1$ may be greater than ninety-eight millimeters. In at least one other possible embodiment, the flushing tube length $L_1$ may be greater or less than ninety-eight millimeters within the range of meters, centimeters, millimeters, or fractions thereof. In at least one other possible embodiment of the present application, the tube end length $L_2$ may be greater than ten millimeters. In at least one other possible embodiment, the tube end length $L_2$ may be less than ten millimeters. In at least one other possible embodiment of the present application, the tube end length $L_2$ may be greater than or less than ten millimeters within the range of meters, centimeters, millimeters, or fractions thereof. In at least one other possible embodiment of the present application, the proportion of the tube end length $L_2$ to the flushing tube length $L_1$ may be greater than 0.102 or a ratio of five to forty-nine. In at least one other possible embodiment, the proportion of the tube end length $L_2$ to the flushing tube length $L_1$ may be less than 0.102, or less than a ratio of five to forty-nine. In at least one other possible embodiment of the present application, the proportion of the tube end length $L_2$ to the flushing tube length $L_1$ may be greater than 0.102, or greater than a ratio of five to forty-nine.

Figure 1D:
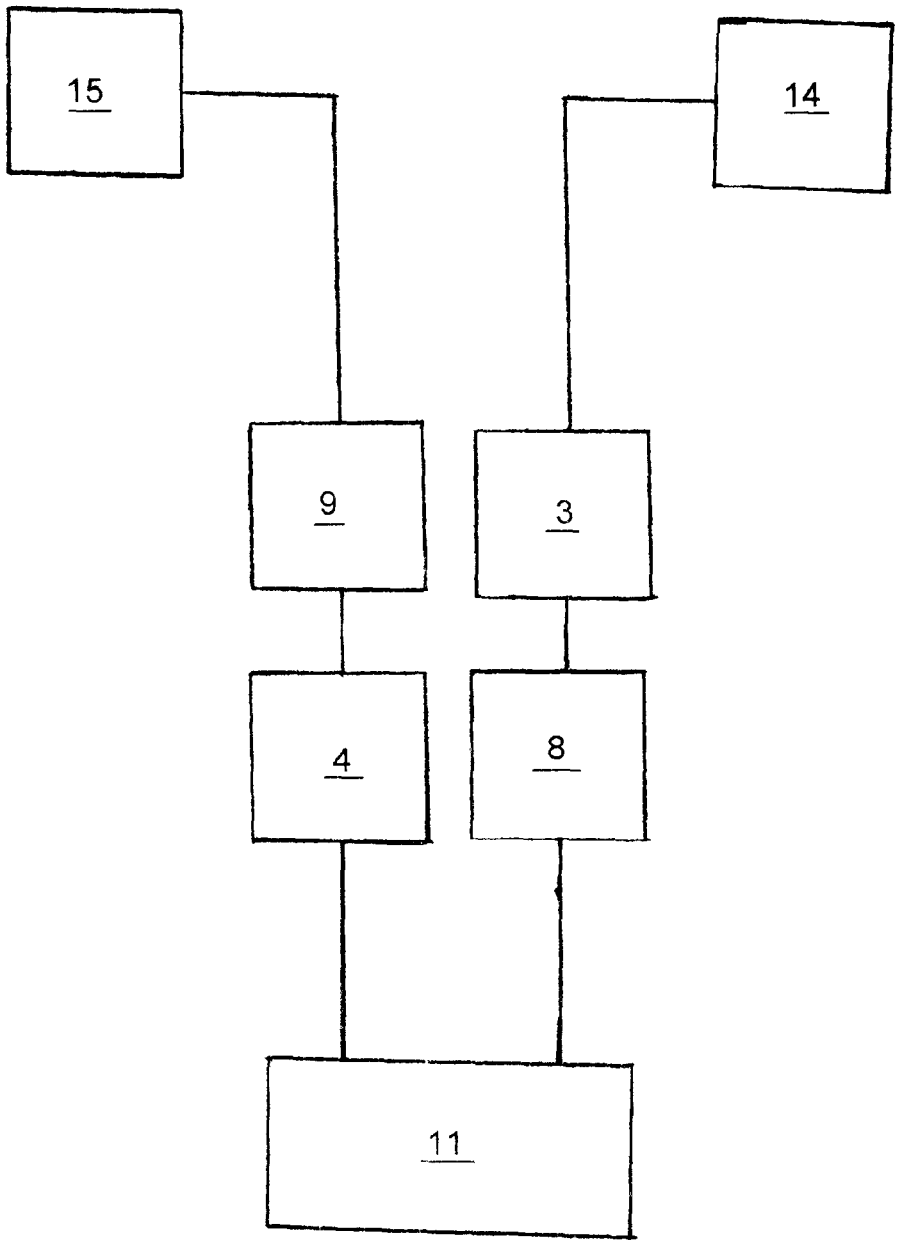
FIG. 1D shows a simplified sectional representation of a filling element 2 according to at least one possible embodiment where the rinsing or flushing tube is situated in an operating position.

FIG. 1D shows a simplified sectional representation of a filling element according to at least one possible embodiment of the present application. The filling element comprises a tube housing 9, a flushing tube 4, a liquid valve 3, a liquid duct 8, and a seal 11. The full flow of liquid product may be introduced from the liquid valve 3 into the liquid duct 8 when the liquid valve 3 is open. The opening and closing of the liquid valve 3 may be controlled or activated by a liquid valve motor 14. The flushing tube 4 may be moved into the tube housing 9 by means of a piston actuator 15. The flushing tube may be moved through the seal 11 and into a container by means of a piston actuator 15. In this embodiment, the flushing tube 4 may be disposed along a vertical or substantially vertical longitudinal axis. The tube housing 9 may also be disposed along a vertical or substantially vertical longitudinal axis. The axis of the liquid duct 8 and the liquid valve 3 may be inclined relative to the longitudinal axis of the flushing tube 4. The axis of the liquid duct 8 and the liquid valve 3 may be inclined relative to the longitudinal axis of the tube housing 9. The path or direction of the full flow of liquid product as it flows through the liquid duct 8 may be inclined relative to the longitudinal axis of the flushing tube 4. Thus, the path or direction of the full flow of liquid product as it flows into the container may be inclined relative to the longitudinal axis of the flushing tube 4. The relative incline of the liquid valve 3 and the liquid duct 8 may permit space for the tube housing 9 and the flushing tube 4 to be disposed along a longitudinal, or vertical, or substantially vertical axis. The inclined axis of the liquid valve 3 and the liquid duct 8 may be inclined thirteen degrees from the longitudinal axis of the flushing tube 4 and the tube housing 9.

In at least one other possible embodiment of the present application, the inclined axis of the liquid duct 8 may be inclined 6.5 degrees from the longitudinal axis of the flushing tube 4 and the tube housing 9. In at least one other possible embodiment, the inclined axis of the liquid duct 8 may be inclined twenty-six degrees from the longitudinal axis of the flushing tube 4 and the tube housing 9. In other possible embodiments, the incline of the axis of the liquid duct 8 from the longitudinal axis of the flushing tube 4 and the tube housing 9 may vary by degrees or by any increments or fractions of degrees within the range of 6.5 degrees to twenty-six degrees. In at least one other possible embodiment of the present application, the inclined axis of the liquid duct 8 may be inclined less than 6.5 degrees from the longitudinal axis of the flushing tube 4 and the tube housing 9. In at least one other possible embodiment, the inclined axis of the liquid duct 8 may be inclined more than twenty-six degrees from the longitudinal axis of the flushing tube 4 and the tube housing 9.

In at least one possible embodiment of the present application, the liquid duct 8 may comprise an axis that is inclined relative to a vertical or substantially vertical axis. Thus, the flow of liquid through the liquid duct 8 and into the container 1 may be inclined relative to a vertical or substantially vertical axis. In the same embodiment, the flushing tube 4 may comprise an axis that is inclined relative to a vertical or substantially vertical axis. The flushing tube 4 may be disposed at a non-zero angle relative to the vertical or substantially vertical axis. The flushing tube 4 may also be disposed at a non-zero angle relative to the axis of the liquid duct 8. The flushing tube 4 may be disposed at a non-zero distance from the liquid duct 8. Thus, the liquid duct 8 and the flushing tube 4 may each comprise an axis that is inclined relative to a vertical or substantially vertical axis.

In at least one possible embodiment of the present application, the axis of the liquid valve 3 may be offset from the axis of the liquid duct 8. The liquid valve 3 may comprise an axis that is different than the axis of the liquid duct 8. For example, the liquid duct 8 may comprise an axis that is inclined relative to the vertical or substantially vertical longitudinal axis of the flushing tube 4 and the tube housing 9. The liquid valve 3 may comprise an axis that is, for example, parallel or substantially parallel to the vertical or substantially vertical longitudinal axis of the flushing tube 4 and the tube housing 9.

Figure 2:
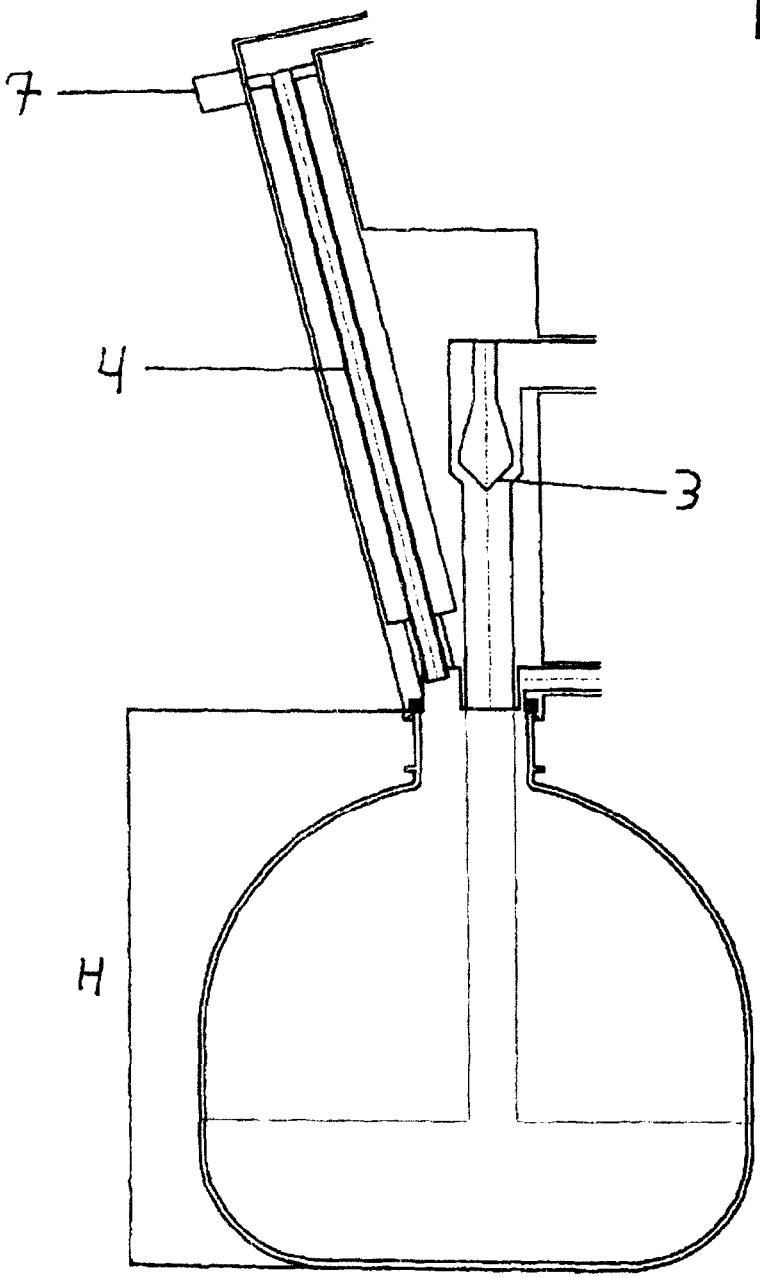
FIG. 2 also shows a simplified sectional representation of a filler element according to at least one possible embodiment but where the rinsing or flushing tube is situated in a parked position.

FIG. 2 shows a filling process of another, smaller, container 1.

The liquid valve 3 is open so that the liquid product can flow into the container 1. The rinsing or flushing tube 4 is situated in its parked position, thereby being totally or virtually totally removed from the region of the liquid product flowing into the container 1. The liquid product consequently flows into the container 1 as full flow with the smallest possible surface.

FIG. 2 may show one possible embodiment in which there may be no bend or relative angle in the end portion or tube end of the flushing tube 4. The length of the flushing tube 4 may comprise one axis inclined relative to the vertical or substantially vertical longitudinal axis of the liquid duct 8 and the liquid valve 3. At least one other possible embodiment of the present application may possibly feature a flushing tube 4 with a bend or relative angle at the end portion or tube end. For example at least one other possible embodiment may possibly feature a flushing tube 4 that is similar to the flushing tube 4 in the possible embodiments shown in FIGS. 1 and 1A.

As the rinsing or flushing tube 4 is removable totally or virtually totally from the region of the liquid product flow, it is additionally possible to dispense with the swirling body that has been usual up to now guiding the liquid product onto the inside walls of the container, thereby additionally supporting the liquid product flowing into the container in as uniform and laminar a flow as possible.

The gas contained in the container 1 and displaced by the liquid product flowing in escapes via a gas path 5 provided inside the filler element.

In at least one embodiment of the present application, the gas path 5 may be connected, for example, to an outlet or a gas sink. When the container 1 is flushed with oxygen-free gas, the oxygenated gas may be displaced from the container 1, through the gas path 5, and into an outlet or gas sink. When the container 1 is being filled with liquid beverage product, the oxygen-free gas may be displaced from the container 1, through the gas path 5, and into the outlet or gas sink.

To achieve as advantageous a rinsing or flushing process as possible, it is advantageous to design the rinsing or flushing tube 4 or its receiving means in such a manner that the rinsing or flushing tube 4 can be inserted into the container 1 in as vertical a manner as possible and in as deep a manner as possible.

Such a method of operation manages to embody, in an almost perfect or highly desired manner, a directed gas movement inside the container 1. As the geometric conditions of a container filling machine, in at least one possible embodiment the tight geometric conditions at a filler element, as a rule do not allow for a vertical arrangement of the rinsing or flushing tube 4, it is provided, for example, to arrange the rinsing or flushing tube 4 in a certain inclined position.

In at least one possible embodiment of the present application, the main axis of the flushing tube 4 may be inclined relative to the longitudinal axis of the liquid duct 8. The main axis of the flushing tube 4 may also be inclined relative to the path of the liquid product flow into the container 1. The relative incline of the flushing tube 4 may permit the flushing tube 4 to be inserted into the container 1 while also permitting the flushing tube 4 to be disposed at a distance from the liquid duct 8 and out of the way of the liquid product flow into the container 1. Therefore, the relative incline of the flushing tube 4 may permit the flushing tube 4 to be out of the way of the full flow of liquid product while also minimizing the amount of space taken up by the filling element 2.

In order to make possible, in the case of the proposed separated arrangement of rinsing or flushing tube 4 and liquid product flow, both a vertical or substantially vertical arrangement of the rinsing or flushing tube 4 and a vertical emerging of the liquid product flow, it is provided as an alternative, for example, to develop the liquid duct 8 in such a manner that the liquid valve 3 is outside the axis of the liquid product flow flowing into the container 1.

In at least one possible embodiment of the present application, the liquid valve 3 may be offset from the longitudinal axis of the liquid duct 8 and from the path of liquid product flow into the container 1. The offsetting of the liquid valve 3, or the positioning of the liquid valve 3, may possibly permit space for the flushing tube 4 to be positioned parallel or substantially parallel to the longitudinal axis of the liquid duct 8 and to the path of the liquid product flow into container 1. The flushing tube 4 thus may be inserted into the container 1 on a longitudinal axis parallel or substantially parallel to the liquid duct 8 and to the liquid product flow into the container 1.

In order, also in the case of an inclined position of the rinsing or flushing tube 4, to make possible optimum and consequently rapid rinsing or flushing of the container 1, it is also provided to move the bottom end of the rinsing or flushing tube 4 by means of a bend or bending back into a vertical or substantially vertical alignment, the embodiment of a directed gas movement thereby being additionally supported.

In at least one possible embodiment of the present application, the main axis of the flushing tube 4 may be inclined relative to the longitudinal axis of the liquid duct 8. The main axis of the flushing tube 4 may also be inclined relative to liquid product flow while at least a portion of the end portion or tube end of the flushing tube 4 may be disposed vertically or substantially vertically toward the floor or bottom of the container 1. The end portion or tube end of the flushing tube 4 may be disposed perpendicular, substantially perpendicular, or substantially transverse in relation to the bottom of the container 1. The relative angle of the end portion or tube end of the flushing tube 4 may increase the contact of oxygen-free gas with the bottom of the container 1. The relative angle of the end portion or tube end of the flushing tube 4 may consequently maximize the displacement of oxygenated gas out of the container 1 in the direction of the gas path 5.

In order also to be able to rinse or flush and to fill containers of the most varied dimensions, it is provided according to at least one possible embodiment of the present application to develop the rinsing or flushing tube 4 or its receiving means in such a manner that the depth of insertion and/or also the inclined position of the rinsing or flushing tube 4 can be controlled or regulated or modified.

For example, for the reproducible adjustment of two different insertion depths, an element for path definition, for example a locking bolt 6, can be provided on the receiving means of the rinsing or flushing tube 4. If the locking bolt is activated, the rinsing or flushing tube 4 is retained by said locking bolt 6 during the movement out of the parked position into the operating position, the rinsing or flushing tube 4 thereby not being completely inserted into the container 1, which makes the processing of smaller containers possible.

Likewise, for example, it is also possible to measure, influence or define the movement of the rinsing or flushing tube 4 through suitable means such as, for example, linear drives, path measuring systems and/or active movement members. Additional elements are, for example, hydraulic or pneumatic movement drives or movement threads.

Developments of filler elements 2 with a displaceable rinsing or flushing tube 4 simply enable insertion depths of the rinsing or flushing tube 4 into the container corresponding, for instance, to twenty percent or thirty percent of the container height H. Surprisingly, investigations held at the applicant's company found that cost reductions produced through a clear increase in the insertion depth of the rinsing or flushing tube, from savings in oxygen-free process gas and through the improvement and shortening of the rinsing or flushing stage, even vindicate increased production costs to develop a rinsing or flushing tube 4 with a greater insertion depth.

Initial positive effects could be achieved from an insertion depth of more than fifty percent of the container height H. In at least one possible embodiment of the present application clear savings and improvements could be achieved from insertion depths in excess of eighty percent of the container height H.

FIG. 2 may show the filling of a container 1 at the filling element 2. The container 1 may have a container height H. The flushing tube 4 may be configured in such a way that the depth to which the flushing tube 4 is inserted into the container 1 is at least eighty-percent of the container height H. For example, the container height H may be twenty inches. The flushing tube 4 may be configured to be inserted into the container 1 to a depth in the container 1 of seventeen inches, or eighty-five percent of the container height H. In at least one other possible embodiment, the container height H may be greater than twenty inches. In at least one other possible embodiment of the present application, the container height H may be less than twenty inches.

In at least one other possible embodiment of the present application, the flushing tube 4 may be configured to be inserted into the container 1 to a depth in the container 1 that is almost one hundred percent of the container height H. In at least one other possible embodiment, the flushing tube 4 may be configured to be inserted into the container 1 to a depth in the container 1 that the flushing tube 4 is almost in physical contact with the bottom of the container. In at least one other possible embodiment of the present application, the flushing tube 4 may be configured to be inserted into the container 1 to a depth in the container 1 that is fifty percent of the container height H. In at least one other possible embodiment, the flushing tube 4 may be configured to be inserted into the container 1 to a depth in the container 1 that is between fifty percent and one hundred percent of the container height H. In at least one other possible embodiment of the present application, the flushing tube 4 may be configured to be inserted into the container 1 to depths ranging in percentage increments of one percent or greater thereof within the range of one hundred percent to fifty percent of the container height H. In at least one other possible embodiment, the flushing tube 4 may be configured to be inserted into the container 1 to a depth that is less than fifty percent of the container height H.

In the case of rotary-type filling machines, there is a so-called structurally-specific dead angle between the outlet star and the inlet star and no containers 1 are positioned at the filler element in this region. Likewise, all or virtually all media lines are closed in this region and this can result in the rinsing or flushing tube 4 being extended unintentionally.

In order to prevent or substantially prevent, in a reliable manner, this kind of unintentional extending of the rinsing or flushing tube 4 inside said angular region, means are provided according to at least one possible embodiment of the present application which retain the rinsing or flushing tube 4 in a secure manner in its parked position. Said means can, for example, be a magnetically or electromagnetically operating retaining device 7.

FIG. 2 may show the flushing tube 4 in the parked or retracted position. The liquid valve 3 may be open. The liquid valve 3 may be configured to introduce a full flow of liquid product into the container 1. The flushing tube 4 may be held in place by a magnetically or electromagnetically operating retaining device 7. The retaining device 7 may hold the flushing tube 4 completely or virtually completely outside of the container 1 when the flushing tube 4 is in the parked position. The retaining device 7 may hold the flushing tube 4 in such a way that the flushing tube 4 does not physically interrupt, disturb, influence, and/or reroute the movement of the full flow of liquid product. The retaining device 7 may hold the flushing tube 4 in such a way that the flushing tube 4 does not physically interrupt, disturb, influence, and/or reroute movement of the flow of liquid product through the liquid duct 8. The retaining device 7 may hold the flushing tube 4 in such a way that the flushing tube 4 does not physically interrupt, disturb, influence, and/or reroute the movement of the liquid product into the container 1.

The present application has been described above by way of possible exemplary embodiments. It is obvious that numerous modifications and conversions are possible without departing in any way from the scope of the present application.

Thus, it is also possible, in place of an inclined position of the rinsing or flushing tube 4, to provide an inclined position of the liquid product flow. Such a development makes it possible to introduce the rinsing or flushing tube 4 into the container 1 always or essentially always as far as in the direct vicinity of the container bottom. Likewise, it is made possible for the rinsing or flushing tube 4 to be positioned centrally or substantially centrally in relation to the container axis and this promotes the embodiment of a particularly or substantially uniform gas movement for rinsing or flushing the container 1.

At least one possible embodiment of the present application relates to a filler element for filling containers. At least one possible embodiment of the present application is a method for rinsing or flushing and filling containers. Advantageous further developments are provided in other possible embodiments of the present application.

Figure 3:
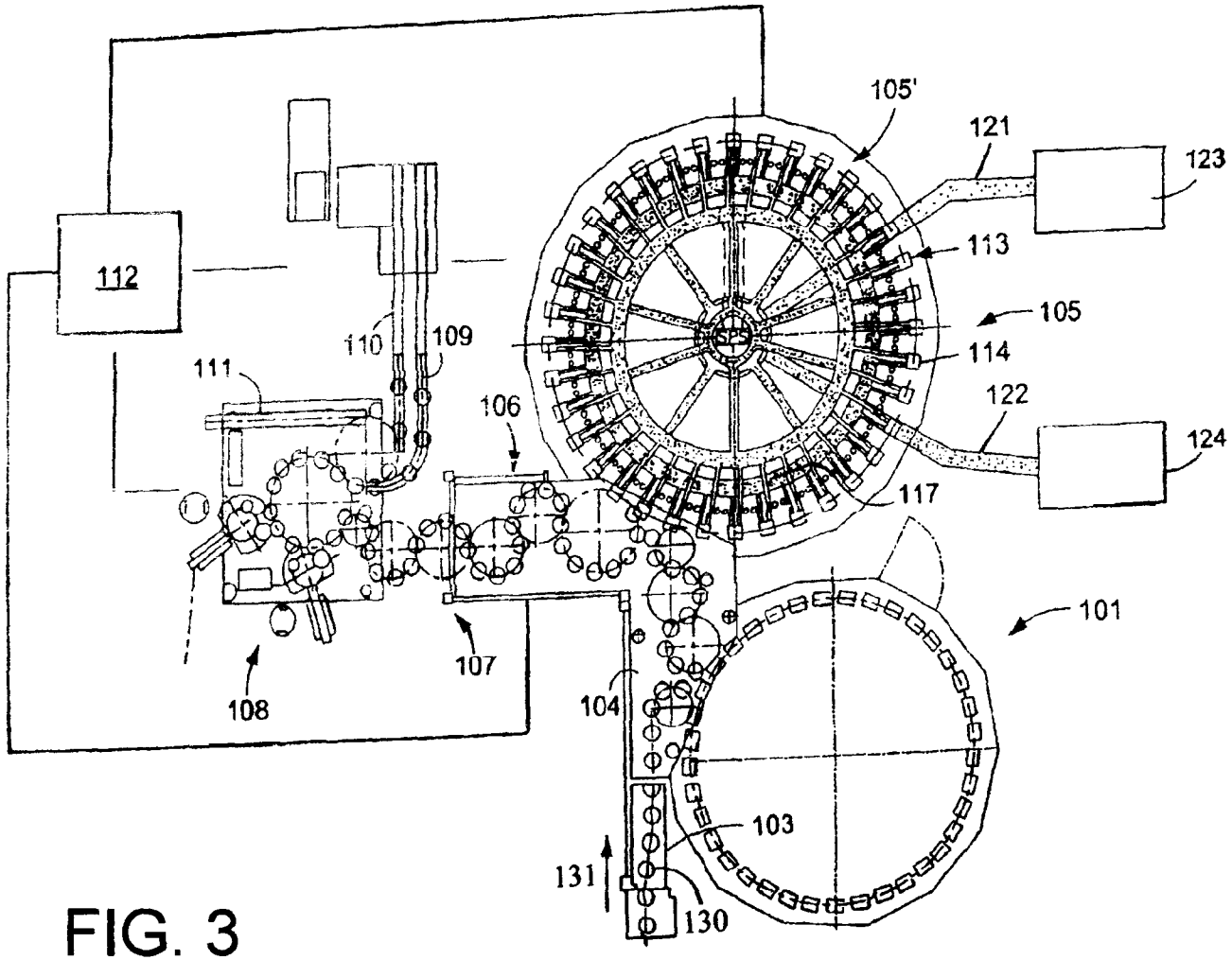
FIG. 3 shows schematically the main components of one possible embodiment example of a system for filling containers, in which system or plant could possibly be utilized at least one aspect, or several aspects, of the embodiments disclosed herein.

FIG. 3 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 3 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 3, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Further developments, advantages and application possibilities of various possible embodiments of the present application are produced from the following description of exemplary embodiments and from the drawings. In this case, all the described and/or graphically represented features form, either individually on their own or in arbitrary combination, are the object of at least one possible embodiment of the present application.

One feature or aspect of an embodiment is believed at the time of the filing of this patent application to possibly reside broadly in a filler element 2 for filling containers, wherein at least one rinsing or flushing process precedes the filling, said filler element having a rinsing or flushing tube 4, which is displaceable between a parked position and an operating position, and a liquid valve 3, and wherein the rinsing or flushing tube 4 and the liquid duct 8 are positioned inside the filler element 2 separated spatially from one another. The parked, or resting position of rinsing or flushing tube 4 is that position in which the said rinsing or flushing tube 4 is outside the container 1.

Another feature or aspect of an embodiment is believed at the time of the filing of this patent application to possibly reside broadly in the filler element 2 for filling containers, wherein the filler element 2 is developed in such a manner that the rinsing or flushing tube 4 is removable completely out of the region of the liquid product flow such that the liquid product is able to flow into the container 1 in full flow.

Yet another feature or aspect of an embodiment is believed at the time of the filing of this patent application to possibly reside broadly in the filler element 2 for filling containers, wherein the main axis of the rinsing or flushing tube 4 is inclined relative to the vertical.

Still another feature or aspect of an embodiment is believed at the time of the filing of this patent application to possibly reside broadly in the filler element 2 for filling containers, wherein the speed vector of the liquid product flowing into the container 1 is inclined relative to the vertical.

A further feature or aspect of an embodiment is believed at the time of the filing of this patent application to possibly reside broadly in the filler element 2 for filling containers, wherein even if the main axis of the rinsing or flushing tube 4 is not oriented vertically, the lower end of the rinsing or flushing tube 4 is oriented vertically or substantially vertically or in the direction of the container bottom.

Another feature or aspect of an embodiment is believed at the time of the filing of this patent application to possibly reside broadly in the filler element 2 for filling containers, wherein there are provided means which influence or define the movement or the depth of insertion of the rinsing or flushing tube 4 into the container 1.

Yet another feature or aspect of an embodiment is believed at the time of the filing of this patent application to possibly reside broadly in the filler element 2 for filling containers, wherein said means are linear drives, hydraulic drives, pneumatic drives, movement threads or locking bolts 6.

Still another feature or aspect of an embodiment is believed at the time of the filing of this patent application to possibly reside broadly in the filler element 2 for filling containers, wherein the movements of the rinsing or flushing tube 4 are brought about substantially by the oxygen-free process gas or by the flow forces that are brought about by the oxygen-free process gas.

A further feature or aspect of an embodiment is believed at the time of the filing of this patent application to possibly reside broadly in the filler element 2 for filling containers, wherein the rinsing or flushing tube 4 is retained in its parked position by means of a retaining device 7.

Another feature or aspect of an embodiment is believed at the time of the filing of this patent application to possibly reside broadly in a method for rinsing or flushing and filling containers, wherein once the container 1 has been positioned at the filler element 2, a rinsing or flushing tube 4 moves out of a parked position into an operating position, and in so doing moves into the container 1, whereupon the gas situated in the container 1 is displaced by an oxygen-free process gas flowing through the rinsing or flushing tube via a gas path 5 out of the container 1, whereupon the rinsing or flushing tube moves out of the operating position into the parked position, whereupon the liquid valve 3 opens, and the liquid product flows into the container 1, whereupon the liquid valve 3 closes, wherein the liquid product flows into the container 1 in full flow.

Yet another feature or aspect of an embodiment is believed at the time of the filing of this patent application to possibly reside broadly in the method for rinsing or flushing and filling containers, wherein the depth to which the rinsing or flushing tube 4 is inserted into the container 1 is more than fifty percent of the container height H.

Still another feature or aspect of an embodiment is believed at the time of the filing of this patent application to possibly reside broadly in the method for rinsing or flushing and filling containers, wherein the depth to which the rinsing or flushing tube 4 is inserted into the container 1 is more than eighty percent of the container height H.

A further feature or aspect of an embodiment is believed at the time of the filing of this patent application to possibly reside broadly in the method for rinsing or flushing and filling containers, wherein the rinsing or flushing tube 4 is inserted into the container 1 as far as in the direct vicinity of the container bottom.

Another feature or aspect of an embodiment is believed at the time of the filing of this patent application to possibly reside broadly in the method for rinsing or flushing and filling containers, wherein the container 1 is impinged upon at least once with negative pressure between the positioning at the filler element 2 and the flowing in of the liquid product.

Yet another feature or aspect of an embodiment is believed at the time of the filing of this patent application to possibly reside broadly in the method for rinsing or flushing and filling containers, wherein the negative pressure generated in the container 1 by the negative pressure impingement is equalized by oxygen-free process gas, wherein the oxygen-free process gas is supplied to the container by means of a controlled gas path, and the oxygen-free process gas can be supplied both in a continuous manner and in an intermittent manner.

Still another feature or aspect of an embodiment is believed at the time of the filing of this patent application to possibly reside broadly in the method for rinsing or flushing and filling containers, wherein with gas path 5 open, the oxygen-free process gas is emitted from the rinsing or flushing tube 4 at least for a determined time.

A further feature or aspect of an embodiment is believed at the time of the filing of this patent application to possibly reside broadly in the method for rinsing or flushing and filling containers, wherein the oxygen-free process gas passes into the container 1 by means of the gas path 5, and the gas displaced out of the container 1 is conducted through the rinsing or flushing tube 4 out of the container 1.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein, except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The following patent is hereby incorporated by reference as if set forth in its entirety herein, except for the exceptions indicated herein: EP 1 216 952 B1, having the following title "Filling machine," and published on Jun. 26, 2002.

All of the patents, patent applications or patent publications, which were cited in the Federal Republic of Germany Office Action dated Jul. 3, 2008, and International Search Report dated Oct. 23, 2008 and/or cited elsewhere are hereby incorporated by reference as if set forth in their entirety herein, except for the exceptions indicated herein, as follows: EP 0 614 850 A1, having the following title "Filling head for filling machines for filling bottles or similar containers with a liquid," published on Sep. 14, 1994; DE 39 12 153 C1, having the following English translation of the German title "Preventing deterioration of solns. by oxidn.—by feeding solns. in containers from which air has been expelled by injected protective gas," published on Aug. 2, 1990; WO 2005/019090 A1, having the following title "Counter-pressure filling device and method for counter-pressure filling," published on Mar. 3, 2005; U.S. Pat. No. 3,765,142 A, having the following title "A method and apparatus for aseptically filling drums," published on Oct. 16, 1973; WO 03/095353, having the following title "A device for removing oxygen from beverage containers," published on Nov. 20, 2003; and EP 1 216 952 A, having the following title "Filling machine," published on Jun. 26, 2002.

Some examples of large-volume containers that may be utilized in at least one possible embodiment of the present application may possibly be demijohns, kegs, barrels, or bottles. These containers may possibly be utilized to hold various volumes of liquids or liquid beverages, for example, wine, whiskey, beer, champagne, or other beverage material. A demijohn, which also may be called a carboy, could be any narrow-necked container used to hold liquids. Demijohns may range in volume from one U.S. gallon to fifteen U.S. gallons. Other various sizes or volumes of demijohns may vary by any range of gallons, quarts, liters, pints, or fractions or increments thereof within the range of one U.S. gallon to fifteen U.S. gallons. Demijohns may range in volume from 3.78 liters to 56.78 liters. Other various sizes or volumes of demijohns may vary by any range of gallons, quarts, liters, pints, or fractions or increments thereof within the range of 3.78 liters to 56.78 liters. Other various sizes or volumes of demijohns may be less than one U.S. gallon or 3.78 liters. Other various sizes or volumes of demijohns may be greater than fifteen U.S. gallons or 56.78 liters.

Demijohns or carboys of various sizes and volumes may also range in various heights. A three gallon demijohn may have a height of 16.5 inches or 41.9 centimeters. A five gallon demijohn may have a height of 19.5 inches or 49.5 centimeters. A six gallon demijohn may have a height of 20.25 inches or 51.4 centimeters. A 6.5 gallon demijohn may have a height of twenty-one inches or 53.3 centimeters. A fifteen gallon demijohn may have a height of twenty-seven inches or 68.6 centimeters. Other various heights of demijohns may vary by any range of feet, inches, centimeters, millimeters, steps of millimeters, or increments or fractions thereof within the range of 16.5 inches to twenty-seven inches. Other various heights of demijohns may vary by any range of feet, inches, centimeters, millimeters, steps of millimeters, or increments or fractions thereof within the range of 41.9 centimeters to 68.6 centimeters. Other various heights of demijohns may be less than 16.5 inches or 41.9 centimeters. Other various heights of demijohns may be greater than twenty-seven inches or 68.6 centimeters.

Kegs also may range in various sizes and volumes. For example, a mini keg may have a volume of 1.32 U.S. gallons or five liters. A full keg, which also may be called a half-barrel, may have a volume of 15.5 U.S. gallons or 58.66 liters. Other sizes of kegs may include a home brew keg with a volume of five U.S. gallons or 18.9 liters, or a sixth-barrel keg with a volume of 5.23 U.S. gallons or 19.8 liters. Other sizes of kegs may include a quarter barrel or "pony keg" with a volume of 7.75 U.S. gallons or 29.3 liters, or an import keg with a volume of 13.2 U.S. gallons or fifty liters. Other various sizes or volumes of kegs may vary by any range of gallons, quarts, liters, pints, or fractions or increments thereof within the range of five liters to 58.66 liters. Other various sizes or volumes of kegs may vary by any range of gallons, quarts, liters, pints, or fractions or increments thereof within the range of 1.32 U.S. gallons to 15.5 U.S. gallons. Other various sizes or volumes of kegs may be less than 1.32 U.S. gallons or five liters. Other various sizes or volumes of kegs may be greater than 15.5 U.S. gallons or 58.66 liters.

Kegs of various sizes and volumes may also range in various heights. For example, a 1.32 gallon mini keg may have a height of 11.4 inches or twenty-nine centimeters. A three gallon keg may have a height of fourteen inches or 35.6 centimeters. A 7.75 gallon keg may have a height of 13.5 inches or 34.3 centimeters. A five gallon keg may have a height of 24.75 inches or 62.9 centimeters. Another five gallon keg may have a height of 22.5 inches or 57.2 centimeters. A 15.5 gallon keg may have a height of 23.3 inches or 59.2 centimeters. Other various kegs of various sizes and volumes may have heights that may vary by any range of feet, inches, centimeters, millimeters, steps of millimeters, or increments or fractions thereof within the range of 11.4 inches to 23.3 inches. Other various kegs of various sizes and volumes may have heights that may vary by any range of feet, inches, centimeters, millimeters, steps of millimeters, or increments or fractions thereof within the range of twenty-nine centimeters to 57.2 centimeters. Other various heights of kegs may be less than 11.4 inches or twenty-nine centimeters. Other various heights of kegs may be greater than 23.3 inches or 59.2 centimeters.

Barrels or casks, for example, pins, firkins, kilderkins, puncheons, rundlets, tierces, pipes, butts, and tuns may also range in various sizes and volumes. A pin may have a volume of 4.5 Imperial gallons or 20.45 liters. A firkin may have a volume of nine Imperial gallons or 40.91 liters. A kilderkin may have a volume of eighteen Imperial gallons or 81.82 liters. A barrel may have a volume of thirty-six Imperial gallons or 163.65 liters. A hogshead may have a volume of fifty-four Imperial gallons or 245.49 liters. A puncheon, or pon, or tertian may have a volume of seventy-two Imperial gallons or 327.32 liters. A butt may have a volume of one hundred and eight Imperial gallons or 490.98 liters. A pipe may have a volume of one hundred and twenty-six Imperial gallons or 572.8 liters. A tun may have a volume of two hundred and sixteen Imperial gallons or 981.95 liters. Other various sizes or volumes of barrels or casks may vary by any range of gallons, quarts, liters, pints, or fractions or increments thereof within the range of 20.45 liters to 981.95 liters. Other various sizes or volumes of barrels or casks may vary by any range of gallons, quarts, liters, pints, or fractions or increments thereof within the range of 4.5 Imperial gallons to two hundred and sixteen Imperial gallons. Other various sizes or volumes of barrels or casks may be less than 4.5 Imperial gallons or 20.45 liters. Other various sizes or volumes of barrels or casks may be greater than two hundred and sixteen Imperial gallons or 981.95 liters.

Barrels or casks of various sizes and volumes may also range in various heights. For example, a firkin may have a height of eighteen inches or 45.7 centimeters. A kilderkin may have a height of twenty-four inches or sixty-one centimeters. A forty gallon barrel may have a height of thirty-five inches or 88.9 centimeters. A hogshead may have a height of thirty-seven inches or ninety-four centimeters. A butt may have a height of fifty inches or one hundred and twenty-seven centimeters. A pipe barrel may have a height of fifty-seven inches or 144.8 centimeters. Other various heights of kegs may vary by any range of feet, inches, centimeters, millimeters, steps of millimeters, or increments or fractions thereof within the range of eighteen inches to fifty-seven inches. Other various heights of barrels may vary by any range of feet, inches, centimeters, millimeters, steps of millimeters, or increments or fractions thereof within the range of 45.7 centimeters to 144.8 centimeters. Other various heights of kegs may be less than eighteen inches or 45.7 centimeters. Other various heights of kegs may be greater than fifty-seven inches or 144.8 centimeters.

Bottles, for example, wine or champagne bottles, may also range in various sizes and volumes. A jeroboam may have a volume of 4.5 liters. A rehoboam may also have a volume of 4.5 liters. A franzia may have a volume of five liters. An imperial may have a volume of six liters. A methuselah may also have a volume of six liters. A mordechai may have a volume of nine liters. A salmanazar may also have a volume of nine liters. A balthazar may have a volume of twelve liters. A nebuchadnezzar may have a volume of fifteen liters. A melchior may have a volume of eighteen liters. A solomon may have a volume of twenty liters. A sovereign may have a volume of twenty-five liters. A primat may have a volume of twenty-seven liters. A melchizedek may have a volume of thirty liters. Other various sizes or volumes of bottles may vary by any range of gallons, quarts, liters, pints, or fractions or increments thereof within the range of 4.5 liters to thirty liters. Other various sizes or volumes of bottles may be less than 4.5 liters. Other various sizes or volumes of bottles may be greater than thirty liters.

Bottles of various sizes and volumes may also range in various heights. A jeroboam may have a height of 19.5 inches or 49.5 centimeters. A methuselah may have a height of twenty-two inches or 55.9 centimeters. A balthazar may have a height of twenty-eight inches or 71.1 centimeters. A nebuchadnezzar may have a height of thirty-one inches or 78.7 centimeters. Other various heights of bottles may vary by any range of feet, inches, centimeters, millimeters, steps of millimeters, or increments or fractions thereof within the range of 19.5 inches to thirty-one inches. Other various heights of bottles may vary by any range of feet, inches, centimeters, millimeters, steps of millimeters, or increments or fractions thereof within the range of 49.5 centimeters to 78.7 centimeters. Other various heights of bottles may be less than 19.5 inches or 49.5 centimeters. Other various heights of kegs may be greater than thirty-one inches or 78.7 centimeters.

The necks, mouths, or openings of barrels, kegs, demijohns, or bottles may also range in various widths or diameters. Rubber stoppers for sealing the necks or mouths of barrels, kegs, demijohns, or bottles may possibly range in width or diameter from 1.96 inches to five inches. Rubber stoppers for sealing the necks or mouths of barrels, kegs, demijohns, or bottles may possibly range in width or diameter from fifty millimeters to one hundred and twenty-seven millimeters. Corks for sealing the mouths of barrels, kegs, demijohns, or bottles may possibly range in width or diameter from two inches to 2.25 inches. Corks for sealing the mouths of barrels, kegs, demijohns, or bottles may possibly range in width or diameter from 57.1 millimeters to 50.8 millimeters. There may also be other various other larger and/or smaller sizes and diameters of corks, stoppers, caps, or lids that may be utilized in at least one possible embodiment of the present application. Corks, stoppers, caps, or lids may have diameters varying by inches, centimeters, millimeters, steps of millimeters, or any fractions or increments thereof within the range of 1.96 inches to five inches. Corks, stoppers, caps, or lids may have diameters varying by inches, centimeters, millimeters, steps of millimeters, or any fractions or increments thereof within the range of 50.8 millimeters to one hundred and twenty-seven millimeters.

Thus, barrels, kegs, demijohns, bottles, or other containers that may possibly be utilized in at least one embodiment of the present application may have necks or mouths that vary in diameter from 1.96 inches to five inches. Barrels, kegs, demijohns, bottles, or other containers may have necks or mouths with diameters varying by inches, centimeters, millimeters, steps of millimeters, or any fractions or increments thereof within the range of fifty millimeters to one hundred and twenty-seven millimeters. Barrels, kegs, demijohns, bottles, or other containers that may possibly be utilized in at least one embodiment of the present application may have necks or mouths that vary in diameter from five inches to 1.96 inches.

Barrels, kegs, demijohns, bottles, or other containers may have necks or mouths with diameters varying by inches, centimeters, millimeters, steps of millimeters, or any fractions or increments thereof within the range of 1.96 inches to five inches. Barrels, kegs, demijohns, bottles, or other containers may also have necks or mouths with diameters greater than one hundred and twenty-seven millimeters or five inches. Barrels, kegs, demijohns, bottles, or other containers may also have necks or mouths with diameters less than fifty millimeters or 1.96 inches.

Some examples of filling machines that utilize electronic control devices to control various portions of a filling or bottling process and that may possibly be utilized or possibly adapted for use in at least one possible embodiment of the present application may possibly be found in the following U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

Some examples of pneumatic arrangements that may possibly be utilized or possibly adapted for use in at least one possible embodiment of the present application may possibly be found in the following U.S. Pat. No. 6,609,767 issued to Mortenson et al. on Aug. 26, 2003; U.S. Pat. No. 6,632,072 issued to Lipscomb et al. on Oct. 14, 2003; U.S. Pat. No. 6,637,838 issued to Watanabe on Oct. 28, 2003; U.S. Pat. No. 6,659,693 issued to Perkins et al. on Dec. 9, 2003; U.S. Pat. No. 6,668,848 issued to Ladler et al. on Dec. 30, 2003; and U.S. Pat. No. 6,676,229 issued to Marra et al. on Jan. 13, 2004.

Some examples of pneumatic drives that may possibly be utilized or possibly adapted for use in at least one possible embodiment of the present application may possibly be found in the following U.S. Pat. No. 5,676,033 issued on Oct. 14, 1997 to Szabo; U.S. Pat. No. 4,841,845 issued to Beullens on Jun. 27, 1989; U.S. Pat. No. 6,633,015 issued to Nguyen, et al. on Oct. 14, 2003; U.S. Pat. No. 4,794,841 issued to Kemmler, et al. on Jan. 3, 1989; U.S. Pat. No. 5,432,653 issued to Moore, et al. on Jul. 11, 1995; U.S. Pat. No. 4,563,939 issued to Siegrist on Jan. 14, 1986; U.S. Pat. No. 4,300,351 issued to Grullmeier on Nov. 17, 1981; and U.S. Pat. No. 4,414,882 issued to Frei on Nov. 14, 1983.

Some examples of linear drives that may possibly be utilized or possibly adapted for use in at least one possible embodiment of the present application may possibly be found in the following U.S. Pat. No . 7,649,285 issued to Ueda on Jan. 19, 2010; U.S. Pat. No. D596,652 issued to Roither, et al. on Jul. 21, 2009; U.S. Pat. No. 7,528,561 issued to Kawai, et al. on May 5, 2009; U.S. Pat. No. 6,992,408 issued to Finkbeiner, et al. on Jan. 31, 2006; U.S. Pat. No. 7,064,464 issued to Ickinger on Jun. 20, 2006; and U.S. Pat. No. 7,055,423 issued to Stoll, et al. on Jun. 6, 2006.

Some examples of hydraulic distributors that may possibly be utilized or possibly adapted for use in at least one possible embodiment of the present application may possibly be found in the following U.S. Pat. No. 4,320,781 issued to Bouvet et al. on Mar. 23, 1982; U.S. Pat. No. 4,549,567 issued to Horton on Oct. 29, 1985; U.S. Pat. No. 4,844,118 issued to Kervagoret on Jul. 4, 1989; U.S. Pat. No. 4,921,072 issued to Divisi on May 1, 1990; and U.S. Pat. No. 5,806,312 issued to Gauss et al. on Sep. 15, 1998.

Some examples of hydraulic drives that may possibly be utilized or possibly adapted for use in at least one possible embodiment of the present application may possibly be found in the following U.S. Pat. No. 6,993,906 issued to Smothers, et al. on Feb. 7, 2006; U.S. Pat. No. 7,024,964 issued to Fukuchi on Apr. 11, 2006; U.S. Pat. No. 6,990,807 issued to Bird, et al. on Jan. 31, 2006; U.S. Pat. No. 6,968,685 issued to Stall on Nov. 25, 2005; U.S. Pat. No. 4,969,389 issued to Foster on Nov. 13, 1990; U.S. Pat. No. 5,829,336 issued to Schulze on Nov. 3, 1998; and U.S. Pat. No. 7,281,372 issued to Sakai, et al. on Oct. 16, 2007.

Some examples of locking bolts that may possibly be utilized or possibly adapted for use in at least one possible embodiment of the present application may possibly be found in the following U.S. Pat. No. 5,304,021 issued to Oliver, et al. on Apr. 19, 1994; U.S. Pat. No. 5,013,197 issued to Allaert, et al. on May 7, 1991; U.S. Pat. No. 4,655,657 issued to Duran on Apr. 7, 1987; U.S. Pat. No. 4,470,735 issued to Salisbury on Sep. 11, 1984; U.S. Pat. No. 7,198,306 issued to Ambs on Apr. 3, 2007; and U.S. Pat. No. 5,478,341 issued to Cook, et al. on Dec. 26, 1995.

Some examples of control systems which measure operating parameters and learn therefrom that may possibly be utilized or possibly adapted for use in at least one possible embodiment of the present application may possibly be found in the following U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

Some examples of control valve apparatuses that may possibly be utilized or possibly adapted for use in at least one possible embodiment of the present application may possibly be found in the following U.S. Pat. No. 5,406,975 issued to Nakamichi et al. on Apr. 18, 1995; U.S. Pat. No. 5,503,184 issued to Reinartz et al. on Apr. 2, 1996; U.S. Pat. No. 5,706,849 issued to Uchida et al. on Jan. 13, 1998; U.S. Pat. No. 5,975,115 issued to Schwegler et al. on Nov. 2, 1999; U.S. Pat. No. 6,142,445 issued to Kawaguchi et al. on Nov. 7, 2000; and U.S. Pat. No. 6,145,538 issued to Park on Nov. 14, 2000.

Some examples of electric control valves that may possibly be utilized or possibly adapted for use in at least one possible embodiment of the present application may possibly be found in the following U.S. Pat. No. 4,431,160 issued to Burt et al. on Feb. 14, 1984; and U.S. Pat. No. 4,609,176 issued to Powers on Sep. 2, 1986.

Some examples of pneumatic valves which may possibly be utilized or adapted for use in at least one possible embodiment may possibly be found in the following U.S. Pat. No. 6,772,791, entitled "Directly operated pneumatic valve having an air assist return;" U.S. Pat. No. 6,729,346, entitled "Pneumatic valve;" U.S. Pat. No.6,676,107, entitled "Control element, especially a pneumatic valve;" U.S. Pat. No. 6,550,416, entitled "Pneumatic valve device;" U.S. Pat. No. 6,543,481, entitled "Pilot operated pneumatic valve;" U.S. Pat. No. 6,488,050, entitled "Pneumatic valve assembly;" U.S. Pat. No. 6,089,251, entitled "Pneumatic valve;" U.S. Pat. No. 4,526,341, entitled "Pneumatic shut-off valve;" U.S. Pat. No. 4,515,183, entitled "Pneumatic control valve;" and U.S. Pat. No. 4,480,663, entitled "Pneumatic relay valve."

Some examples of hydraulic valves which may possibly be utilized or adapted for use in at least one possible embodiment may possibly be found in the following U.S. Pat. No. 6,712,090, entitled "Hydraulic valve;" U.S. Pat. No. 6,745,557, entitled "Hydraulic valve arrangement;" U.S. Pat. No. 6,578,819, entitled "Hydraulic valve;" U.S. Pat. No. 6,505,645, entitled "Multiple hydraulic valve assembly with a monolithic block; U.S. Pat. No. 6,499,505, entitled "Hydraulic valve arrangement;" U.S. Pat. No. 6,427,721, entitled "Hydraulic valve arrangement with locking function;" U.S. Pat. No. 6,412,392, entitled "Hydraulic valve for a hydraulic consumer of a vehicle;" U.S. Pat. No. 6,397,891, entitled "Hydraulic valve, in particular, adjustable pressure control valve;" U.S. Pat. No. 6,349,743, entitled "High-pressure hydraulic valve;" and U.S. Pat. No. 6,305,418, entitled "Hydraulic valve."

Some examples of electric valves which may possibly be utilized or adapted for use in at least one possible embodiment may possibly be found in the following U.S. Pat. No. 5,941,502, entitled "Electric valve assembly and method of making same;" U.S. Pat. No. 5,161,776, entitled "High speed electric valve;" U.S. Pat. No. 4,770,389, entitled "Electric valve device;" U.S. Pat. No. 4,699,167, entitled "Electric valve;" U.S. Pat No. 4,681,298, entitled "Slidable electric valve device having a spring;" U.S. Pat. No. 4,580,761, entitled "Electric valve device having a rotatable core;" and U.S. Pat. No. 4,498,491, entitled "Thermo-electric valve."

Some examples of path measuring systems that may possibly be utilized or possibly adapted for use in at least one possible embodiment of the present application may possibly be found in the following U.S. Pat. No. 7,157,918 issued to Adamian on Jan. 2, 2007; U.S. Pat. No. 4,806,765 issued to Heinen on Feb. 21, 1989; U.S. Pat. No. 4,519,140 issued to Schmitt on May 28, 1985; U.S. Pat. No. 6,650,109 issued to Reichl, et al. on Nov. 18, 2003; U.S. Pat. No. 7,430,236 issued to Eberle, et al. on Sep. 30, 2008; U.S. Pat. No. 4,334,178 issued to Lipp on Jun. 8, 1982; and U.S. Pat. No. 7,592,720 issued to Busch on Sep. 22, 2009.

Some examples of magnetic and/or electromagnetic retaining devices that may possibly be utilized or possibly adapted for use in at least one possible embodiment of the present application may possibly be found in the following U.S. Pat. No. 4,965,695 issued to Baumann on Oct. 23, 1980; U.S. Pat. No. 6,684,740 issued to Lin on Feb. 3, 2004; U.S. Pat. No. 7,224,251 issued to Wang on May 29, 2007; U.S. Pat. No. 4,742,422 issued to Tigges on May 3, 1988; U.S. Pat. No. 6,854,777 issued to Jung on Feb. 15, 2005; and U.S. Pat. No. 4,779,884 issued to Minati on Oct. 25, 1988.

Some examples of movement threads or screw drives that may possibly be utilized or possibly adapted for use in at least one possible embodiment of the present application may possibly be found in the following U.S. Pat. No. 7,357,048 issued to Hartig, et al. on Apr. 15, 2008; U.S. Pat. No. 6,000,308 issued to LaFountain, et al. on Dec. 14, 1999; U.S. Pat. No. 5,535,638 issued to Willison on Jul. 16, 1996; U.S. Pat. No. 5,704,250 issued to Black on Jan. 6, 1998; U.S. Pat. No. 5,664,372 issued to Williams, et al. on Sep. 9, 1997; U.S. Pat. No. 5,219,099 issued to Spence, et al. on Jun. 15, 1993; and U.S. Pat. No. 4,322,987 issued to Gartner on Apr. 6, 1982.

Some examples of vacuum pumps that may possibly be utilized or possibly adapted for use in at least one possible embodiment of the present application may possibly be found in the following U.S. Pat. No. 7,413,411 issued to Gandet, et al. on Aug. 19, 2008; U.S Pat. No. 7,452,191 issued to Tell on Nov. 18, 2008; U.S. Pat. No. 7,436,093 issued to Brunet on Oct. 14, 2008; U.S. Pat. No. 7,354,254 issued to Gotta, et al. on Apr. 8, 2008; U.S. Pat. No. 7,645,116 issued to Kawasaki, et al. on Jan. 12, 2010; U.S. Pat. No. 7,500,821 issued to Watz on Mar. 10, 2009; and U.S. Pat. No. 7,284,965 issued to Adahan on Oct. 23, 2007.

U.S. patent application Ser. No. 12/209,407, filed on Sep. 12, 2008, having inventor(s) Alois MONZEL, and title "METHOD AND DEVICE FOR THE MANUFACTURE OF DISPOSABLE, ONE-WAY, SINGLE-USE BEVERAGE KEGS FOR USE IN HOME BARS", and its corresponding Federal Republic of Germany Patent Application No. DE 10 2006 026 279.4, filed on Jun. 2, 2006, and International Patent Application No. PCT/EP2007/004600, filed on May 24, 2007, having WIPO Publication No. WO 2007/140884 and inventor(s) Alois MONZEL are hereby incorporated by reference as if set forth in their entirety herein.

The patents, patent applications, and patent publication listed above in the preceding paragraphs are herein incorporated by reference as if set forth in their entirety, except for the exceptions indicated herein. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2007 040 262.9, filed on Aug. 24, 2007, having inventors Ludwig CLÜSSERATH and Dieter-Rolf KRULITSCH, and DE-OS 10 2007 040 262.9 and DE-PS 10 2007 040 262.9, and International Application No. PCT/EP2008/005826, filed on Jul. 17, 2008, having WIPO Publication No. WO2009/026993 A1 and inventors Ludwig CLÜSSERATH and Dieter-Rolf KRULITSCH, are hereby incorporated by reference as if set forth in their entirety herein, except for the exceptions indicated herein, for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein, except for the exceptions indicated herein.

The purpose of incorporating the corresponding foreign equivalent patent applications, that is, PCT/EP2008/005826 and Federal Republic of Germany Patent Application No. 10 2007 040 262.9, is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not generally considered to be incorporated by reference herein.

Statements made in the original foreign patent applications PCT/EP2008/005826 and Federal Republic of Germany Patent Application No. 10 2007 040 262.9 from which this patent application claims priority which do not have to do with the correction of the translation in this patent application are not to be included in this patent application in the incorporation by reference.

Any statements about admissions of prior art in the original foreign patent applications PCT/EP2008/005826 and Federal Republic of Germany Patent Application No. 10 2007 040 262.9 are not to be included in this patent application in the incorporation by reference, since the laws relating to prior art in non-U.S. Patent Offices and courts may be substantially different from the Patent Laws of the United States.

All of the references and documents, cited in any of the documents cited herein, are hereby incorporated by reference as if set forth in their entirety herein, except for the exceptions indicated herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application.

However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Container
2 Filler element
3 Liquid valve
4 Rinsing or flushing tube
5 Gas path
6 Locking bolt
7 Retaining device
8 Liquid duct
H Container height

What is claimed is:

1. A container filling arrangement comprising:

a liquid duct being configured to dispense a stream of liquid along a vertical flow path into a container to fill the container;

a flushing tube being disposed outside of and adjacent said liquid duct, and being configured to dispense a flushing gas into a container to flush out gas present in the container; and said flushing tube being configured to be moved from a parked position to a dispensing position in the vertical flow path in the container, and to be moved back out of the vertical flow path prior to filling of the container.

2. The container filling arrangement according to claim 1, said flushing tube is inclined at an angle with respect to the vertical flow path.

3. The container filling arrangement according to claim 2, wherein said flushing tube comprises a main portion and an end portion that is bent at an angle with respect to said main portion, such that said end portion is oriented essentially parallel to the vertical flow path.

4. The container filling arrangement according to claim 3, wherein the container filling arrangement comprises a movement arrangement configured to control the movement of said flushing tube, which movement arrangement comprises at least one of (A), (B), and (C): (A) a linear, hydraulic, or pneumatic drive, (B) a movement thread, and (C) at least one locking bolt configured to restrict the depth of extension of said flushing tube into a container.

5. The container filling arrangement according to claim 3, wherein the container filling arrangement comprises: a housing configured to store said flushing tube in said parked position, and a retaining device configured to retain said flushing tube in said housing;

said flushing tube is configured to be moved out of said housing into said dispensing position by a pressure force generated by said flushing gas in said housing; and said flushing tube is configured to be moved into said parked position by a pressure force generated by gas in a container upon flushing of the container.

6. The container filling arrangement according to claim 1, wherein said liquid duct is configured to dispense the stream of liquid toward the bottom of the container and away from the side walls of the container.

7. The container filling arrangement according to claim 1, wherein said liquid duct is oriented vertically.

8. The container filling arrangement according to claim 1, wherein said liquid duct is configured to dispense the stream of liquid to form the shape of an essentially circular cylinder.

9. The container filling arrangement according to claim 1, wherein the container filling arrangement is configured to fill large volume containers or kegs.

10. A method of filling containers using a container filling arrangement, said method comprising:

moving a flushing tube, disposed adjacent and outside of a liquid duct, from a parked position to a dispensing position in a vertical flow path in a container to be filled;

dispensing an essentially oxygen-free flushing gas out of said flushing tube and into said container, and thus flushing out gas present in said container; and moving said flushing tube out of the vertical flow path, and then opening said liquid duct and dispensing a stream of liquid out of said liquid duct along the vertical flow path into said container.

11. The method according to claim 10, wherein said step of dispensing a stream of liquid comprises dispensing a solid stream of liquid.

12. The method according to claim 11, wherein said step of moving said flushing tube comprise moving said flushing tube inclined at an angle with respect to the vertical flow path.

13. The method according to claim 12, wherein said step of extending said flushing tube comprises extending said flushing tube until said flushing tube reaches an insertion depth into said container of one of (A) and (B):

(A) greater than 80% of the height of said container; and (B) such that the end of said flushing tube is disposed at the bottom of said container.

14. The method according to claim 13, wherein said method further comprises moving the mouth of said container into sealing engagement with a sealing structure of said filling arrangement disposed adjacent said dispensing opening, and then applying a vacuum to the interior of said container; and said step of flowing said flushing gas comprises equalizing the pressure in said container generated by the vacuum with the flushing gas.

15. The method according to claim 10, wherein said step of dispensing a stream of liquid comprises dispensing said stream of liquid to form the shape of an essentially circular cylinder.

16. The method according to claim 10, wherein said step of dispensing a stream of liquid comprises dispensing said stream of liquid toward the bottom of the container and away from the side walls of the container.

17. The method according to claim 10, wherein said method comprises filling large volume containers or kegs.

* * * * *